US010265878B2

(12) United States Patent
Olson et al.

(10) Patent No.: US 10,265,878 B2
(45) Date of Patent: Apr. 23, 2019

(54) MATERIAL HANDLING SYSTEM AND METHOD OF USE

(71) Applicant: American Handling Systems, Inc., Laurens, IA (US)

(72) Inventors: Michael D. Olson, Laurens, IA (US); Kyle J. Banwart, West Bend, IA (US); Jerome P. Schuller, Mallard, IA (US); Jereld A. Meiers, Piney Flats, TN (US); Peter L. Reis, Fonda, IA (US); Scott L. Frye, Laurens, IA (US); Ryan J. Sobkoweak, Fonda, IA (US); Joseph P. Schomaker, Mallard, IA (US)

(73) Assignee: American Handling Systems, Inc., Laurens, IA (US)

( * ) Notice: Subject to any disclaimer, the term of this patent is extended or adjusted under 35 U.S.C. 154(b) by 342 days.

(21) Appl. No.: 15/040,123

(22) Filed: Feb. 10, 2016

(65) Prior Publication Data

US 2016/0229077 A1 Aug. 11, 2016

Related U.S. Application Data

(60) Provisional application No. 62/114,927, filed on Feb. 11, 2015.

(51) Int. Cl.
*B23K 10/00* (2006.01)
*B26D 7/18* (2006.01)

(52) U.S. Cl.
CPC ..... *B26D 7/1818* (2013.01)

(58) Field of Classification Search
CPC ..... B26D 7/1818; B23K 10/00; B23K 26/00; H05H 1/26; H05H 1/34
USPC ..... 219/121.39, 121.44, 121.48, 121.58, 219/121.67, 121.72
See application file for complete search history.

(56) References Cited

U.S. PATENT DOCUMENTS

| | | | | |
|---|---|---|---|---|
| 6,408,729 | B1 * | 6/2002 | Johnson | B26D 7/18 83/164 |
| 6,467,382 | B1 * | 10/2002 | Willits | B26D 7/18 225/104 |
| 6,540,451 | B1 * | 4/2003 | Mori | B26D 7/1818 408/135 |
| 8,061,247 | B2 * | 11/2011 | Coursey | B26D 7/00 83/109 |
| 9,156,179 | B2 * | 10/2015 | Bauch | B21D 28/10 |
| 10,022,886 | B2 * | 7/2018 | Saunders | B26F 1/384 |

* cited by examiner

*Primary Examiner* — Mark Paschall
(74) *Attorney, Agent, or Firm* — Christopher A. Proskey; BrownWinick Law Firm

(57) ABSTRACT

A material handling system is presented having a frame member and a pair of fork members that form a holding area configured to receive sheet stock therein. The sheet stock includes a plurality of parts that are connected by small tabs of material. The material handling system is used to remove the sheet stock from a cutting tool and dislodge the parts from the sheet stock by impacting the sheet stock with the fork members by rotation or movement of the forks. This arrangement eliminates the need to remove individual parts from a cutting tool, and instead allows for removal of the sheet stock and parts in a single operation thereby improving the utilization rate of the cutting tool and streamlining the manufacturing process.

15 Claims, 26 Drawing Sheets

MATERIAL HANDLING SYSTEM AND METHOD OF USE

PRIORITY DATA

This application claims priority to U.S. Provisional Patent Application Ser. No. 62/114,927 filed Feb. 11, 2015, titled Manipulator System and Method of Use.

FIELD OF THE INVENTION

This invention relates to a manipulator system. More specifically and without limitation, this invention relates to a manipulator system and method of use for handling sheet stock, such as sheet steel.

BACKGROUND OF THE INVENTION

Laser cutting is a technology that uses a laser to cut materials, typically out of sheet stock, such as sheet steel, and is typically used for industrial manufacturing applications. Typically, these systems include a high-power laser and a motion control system, such as a CNC (computer numerical control) system that moves either the laser or the sheet stock in a desired shape to cut out a pattern in the sheet stock. To cut, the focused laser beam is directed at the sheet stock, which either melts, burns or vaporizes the material which can be aided by a jet of gas. The process is generally quick and efficient and provides high quality parts with a high-quality surface finish on the cut edges. As such laser cutting has many desirable attributes and is well suited for use in advanced manufacturing systems.

In a conventional laser cutting system, the sheet stock is placed on a table under the laser and the laser cuts out pieces from the sheet stock. In one arrangement, the laser cuts around the entire periphery of the part, thereby detaching the part from the sheet stock. Once all the pieces are cut out of the sheet stock, what remains of the sheet stock, known as the skeleton, is lifted off of the table leaving behind the free-standing pieces.

While this arrangement is certainly functional, it has its drawbacks. Namely, once the skeleton is removed, either a machine or a person is required to pick up or otherwise remove each of the pieces left behind from the cutting process. This process is undesirable as it is time consuming as the individual pieces are difficult to pick up and the pieces are often heavy, sharp and/or hot.

As such, there is substantial cost related to removing these cut pieces. Either another material handling device must be purchased, installed and programmed to pick up the cut pieces, or a person must be employed to perform this task. Regardless of whether machines or labor is used to remove the parts, the removal process increases manufacturing costs. In addition, because the parts are sitting on the laser cutting tool, the removal process cuts into the through-put of the expensive laser cutting tool thereby further increasing manufacturing costs. In addition, the ergonomics of having a person remove the cut pieces is less than desirable and can cause repetitive-stress-injuries and fatigue.

Therefore, a substantial need exists in the art for an improved process for removing laser cut pieces from sheet stock in a quick, safe, efficient and high quality manner.

Thus, it is a primary object of the invention to provide a manipulator system and method of use that improves upon the state of the art.

Another object of the invention is to provide a manipulator system and method of use that is easy to use.

Yet another object of the invention is to provide a manipulator system and method of use that is safe to use.

Another object of the invention is to provide a manipulator system and method of use that eliminates the need to have a person pick up individual cut pieces from a laser cutting machine.

Yet another object of the invention is to provide a manipulator system and method of use that provides high quality pieces.

Another object of the invention is to provide a manipulator system and method of use that improves through put.

Yet another object of the invention is to provide a manipulator system and method of use that improves safety.

Another object of the invention is to provide a manipulator system and method of use that reduces manufacturing costs.

Yet another object of the invention is to provide a manipulator system and method of use that eliminates the need for additional machinery.

Another object of the invention is to provide a manipulator system and method of use that deposits cut pieces in a collection area.

Yet another object of the invention is to provide a manipulator system and method of use that is fast to use.

Another object of the invention is to provide a manipulator system and method of use that has a simple design.

Yet another object of the invention is to provide a manipulator system and method of use that repeatedly and reproducibly removes parts from sheet stock.

Another object of the invention is to provide a manipulator system and method of use that rarely if ever leaves parts behind.

Yet another object of the invention is to provide a manipulator system and method of use that is usable with sheet stock of varying thickness.

Another object of the invention is to provide a manipulator system and method of use that eliminates awkward manufacturing processes.

Yet another object of the invention is to provide a manipulator system and method of use that has a robust design.

Another object of the invention is to provide a manipulator system and method of use that has a long, useful life.

Yet another object of the invention is to provide a manipulator system and method of use that can be used with a wide array of part designs.

Another object of the invention is to provide a manipulator system and method of use that eliminates ergonomically undesirable processes.

Yet another object of the invention is to provide a manipulator system and method of use that can be fully automated and/or controlled remotely.

Another object of the invention is to provide a manipulator system and method of use that is, relatively speaking, inexpensive.

These and other objects, features, or advantages of the present invention will become apparent from the specification and claims.

SUMMARY OF THE INVENTION

Figure 1:
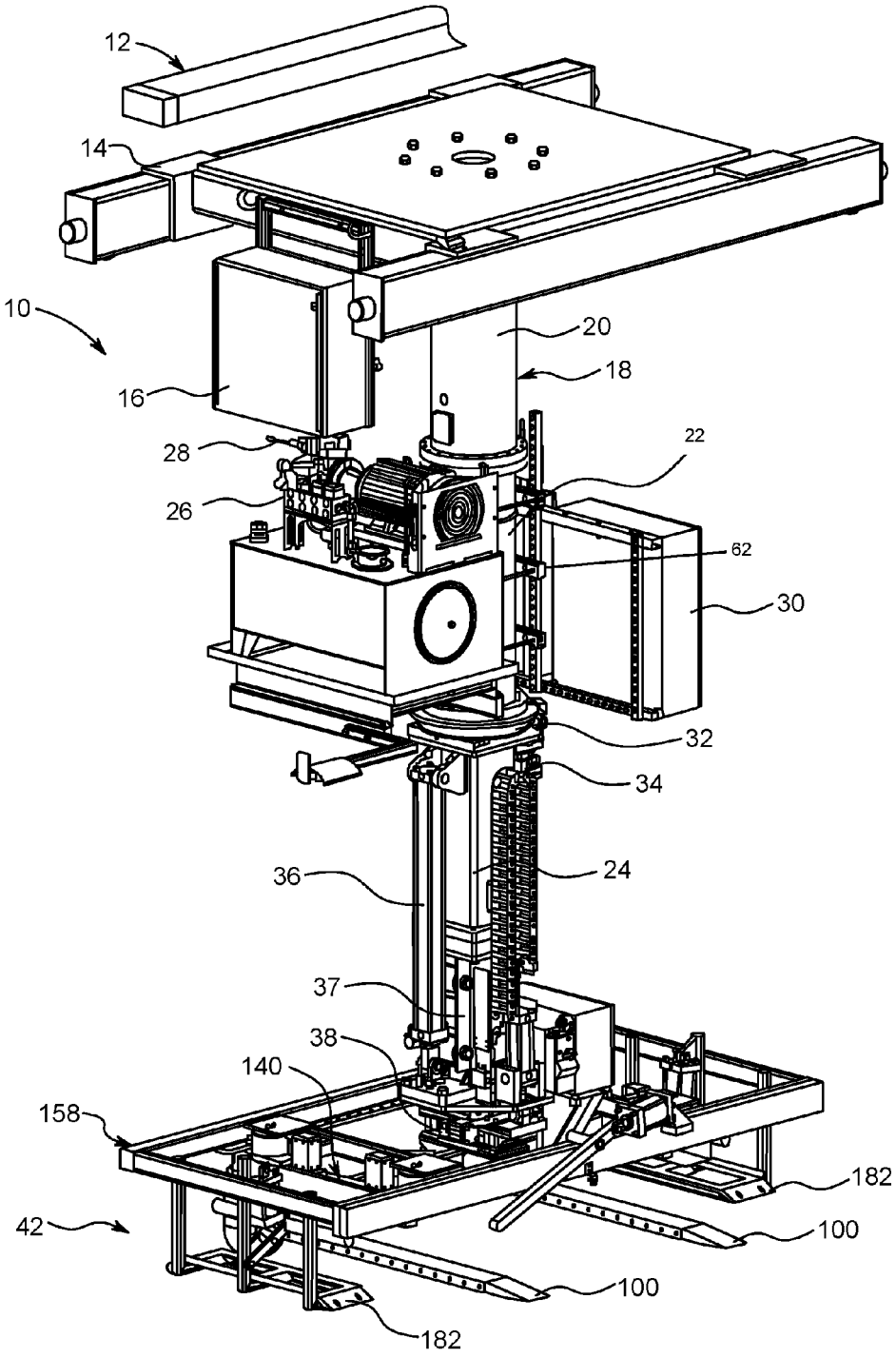
FIG. 1 is a perspective view of a manipulator system, the view showing the overhead system, crane trolley, crane enclosure, post, spacer section, middle section, main post (or lower section), hydraulic power unit, RC receiver, electrical enclosure, rotation bearing, lift cylinder, V-lift section, tilting mechanism and a vibrator tool attached to the manipulator system.
Figure 2:
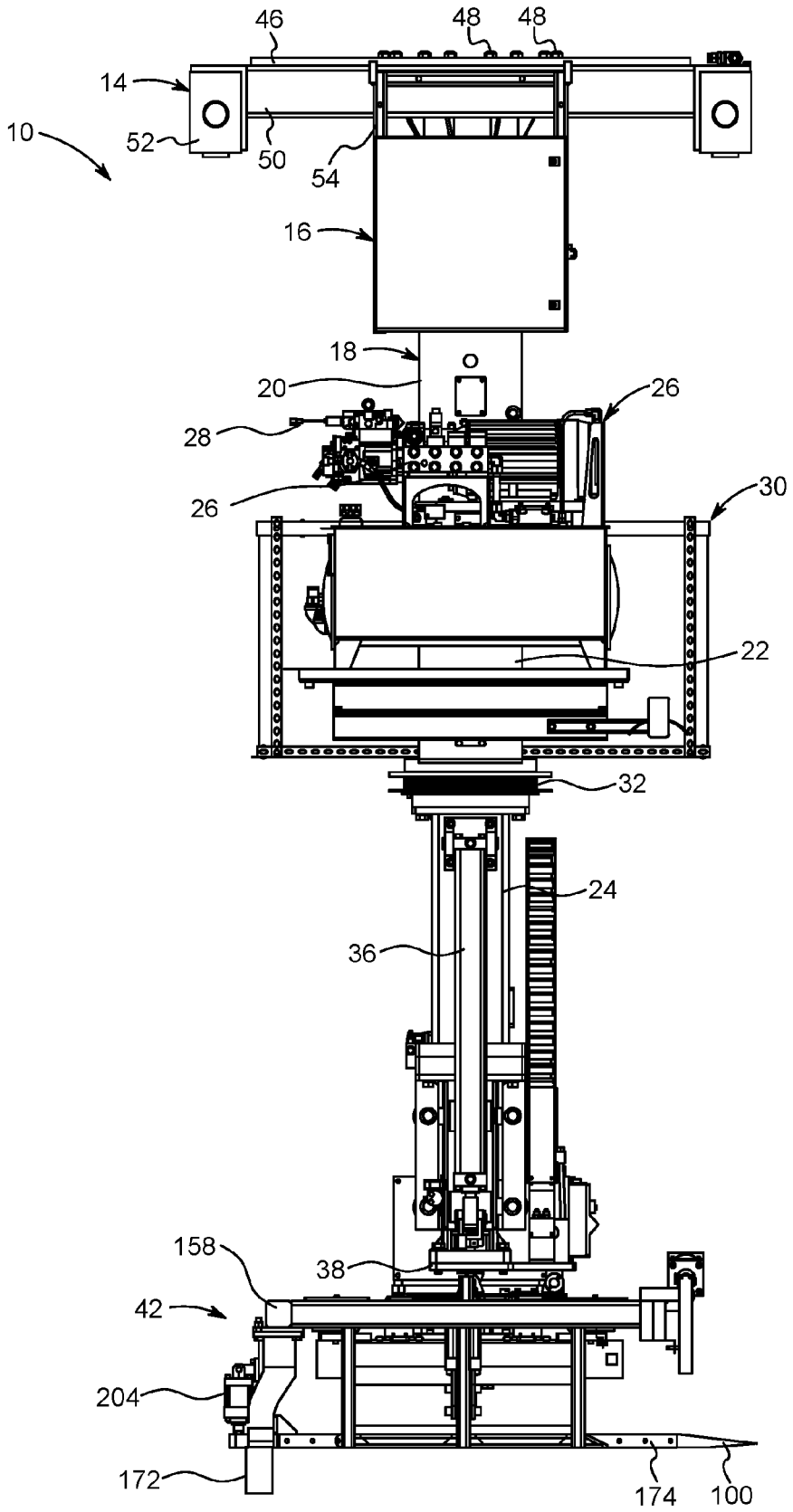
FIG. 2 is a side elevation view of the manipulator system of FIG. 1.
Figure 3:
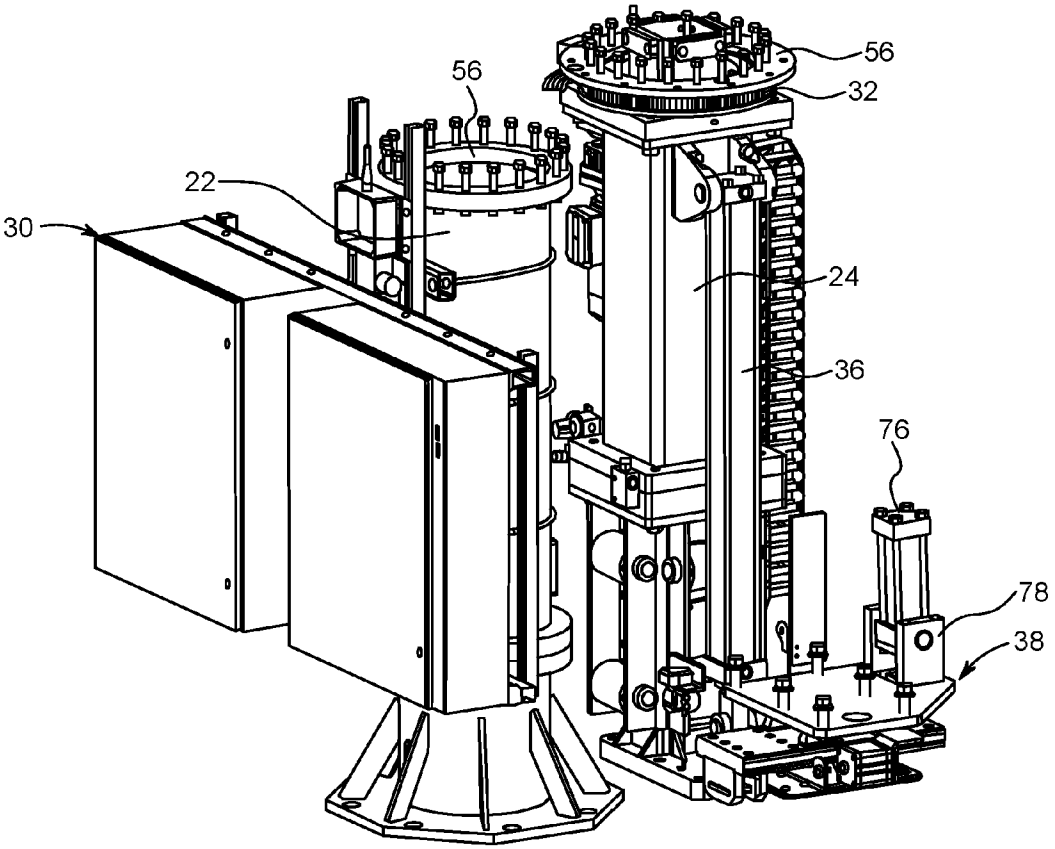
FIG. 3 is a perspective exploded view of the middle section and main post (or lower section), the view showing the mounting flange and electrical enclosure of the middle section, and the view showing the mounting flange of the main post as well as the lift cylinder and tilting mechanism of the main post.
Figure 4:
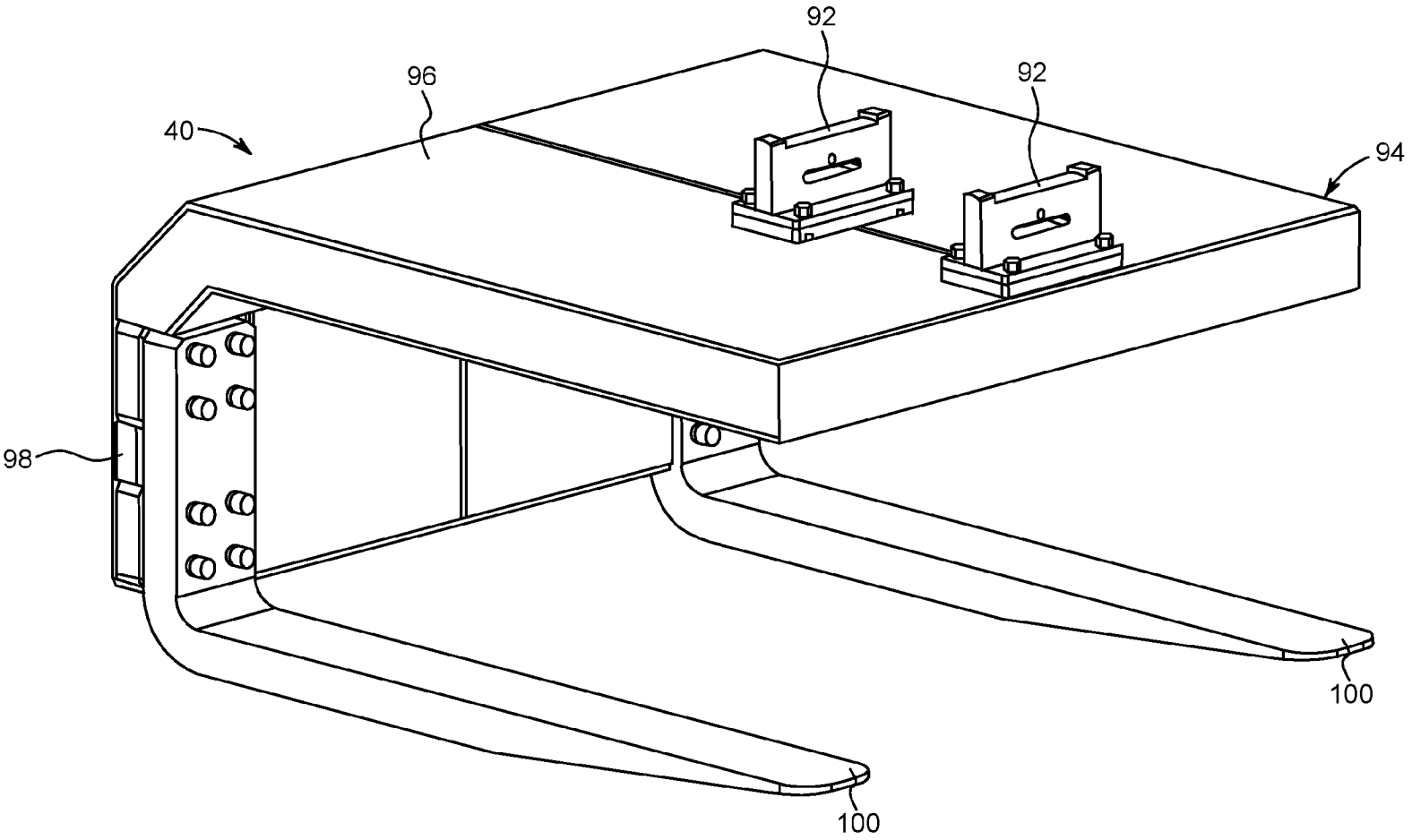
FIG. 4 is a perspective view of a fork tool, with rigidly attached forks that is attachable to the manipulator system of FIG. 1 instead of the vibrator fork tool.
Figure 5:
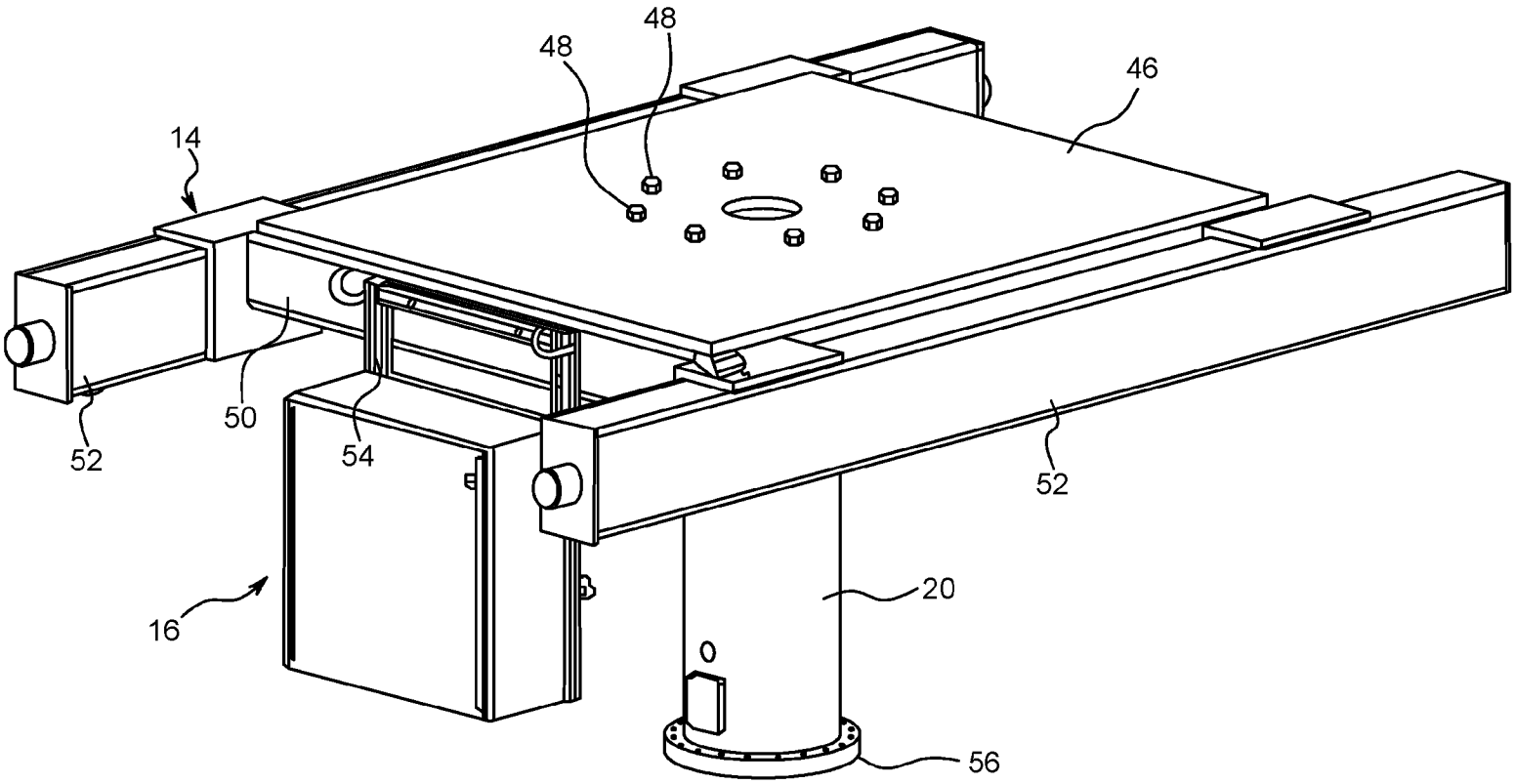
FIG. 5 is a perspective view of the crane trolley system and spacer section of the manipulator system of FIG. 1.
Figure 6:
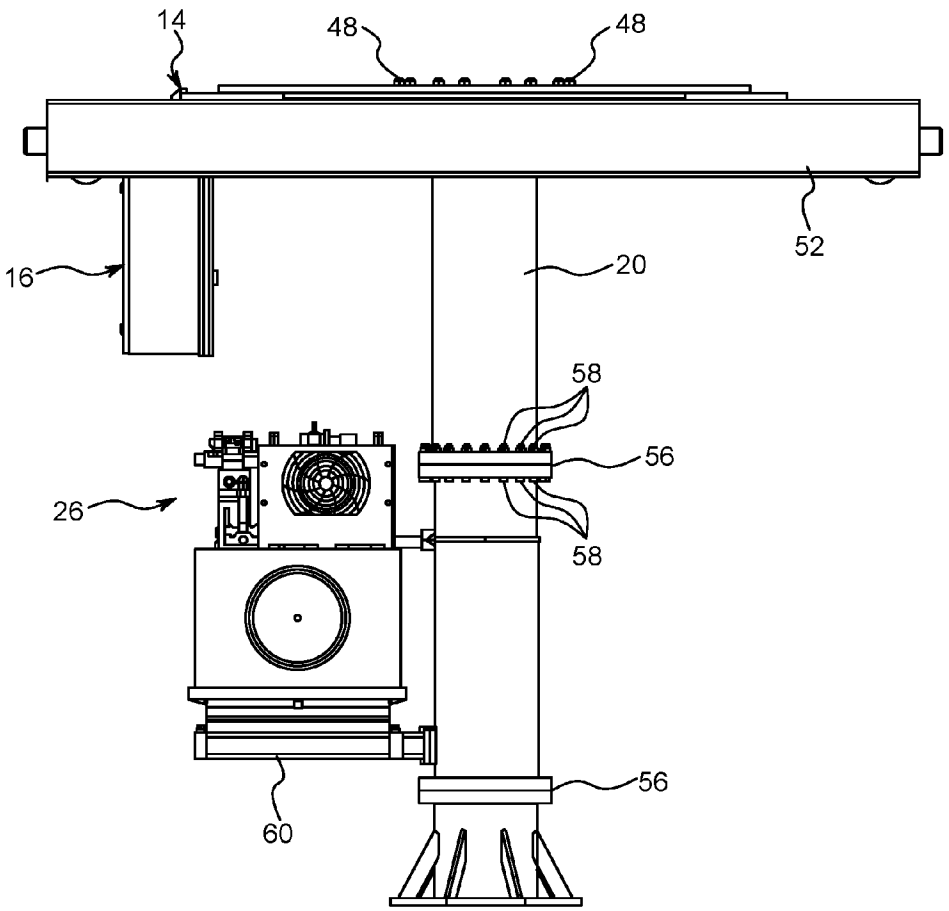
FIG. 6 is a side elevation view of the assembled crane trolley, crane enclosure, post, including spacer section, and hydraulic power unit.
Figure 7:
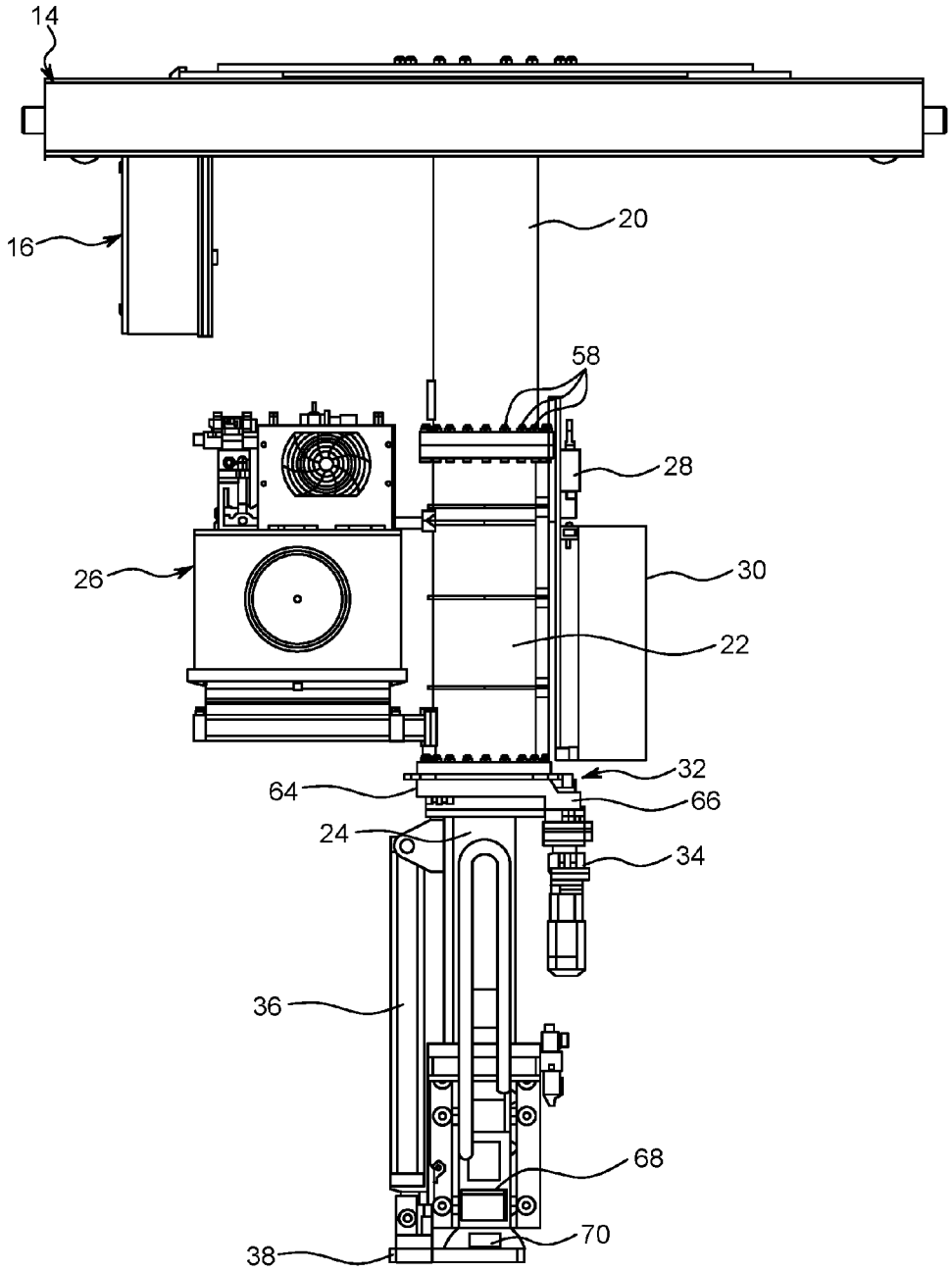
FIG. 7 is a side elevation view of the assembled manipulator system of FIG. 1 without the vibrator tool attached, the view particularly showing the rotation motor and rotation bearing.
Figure 8:
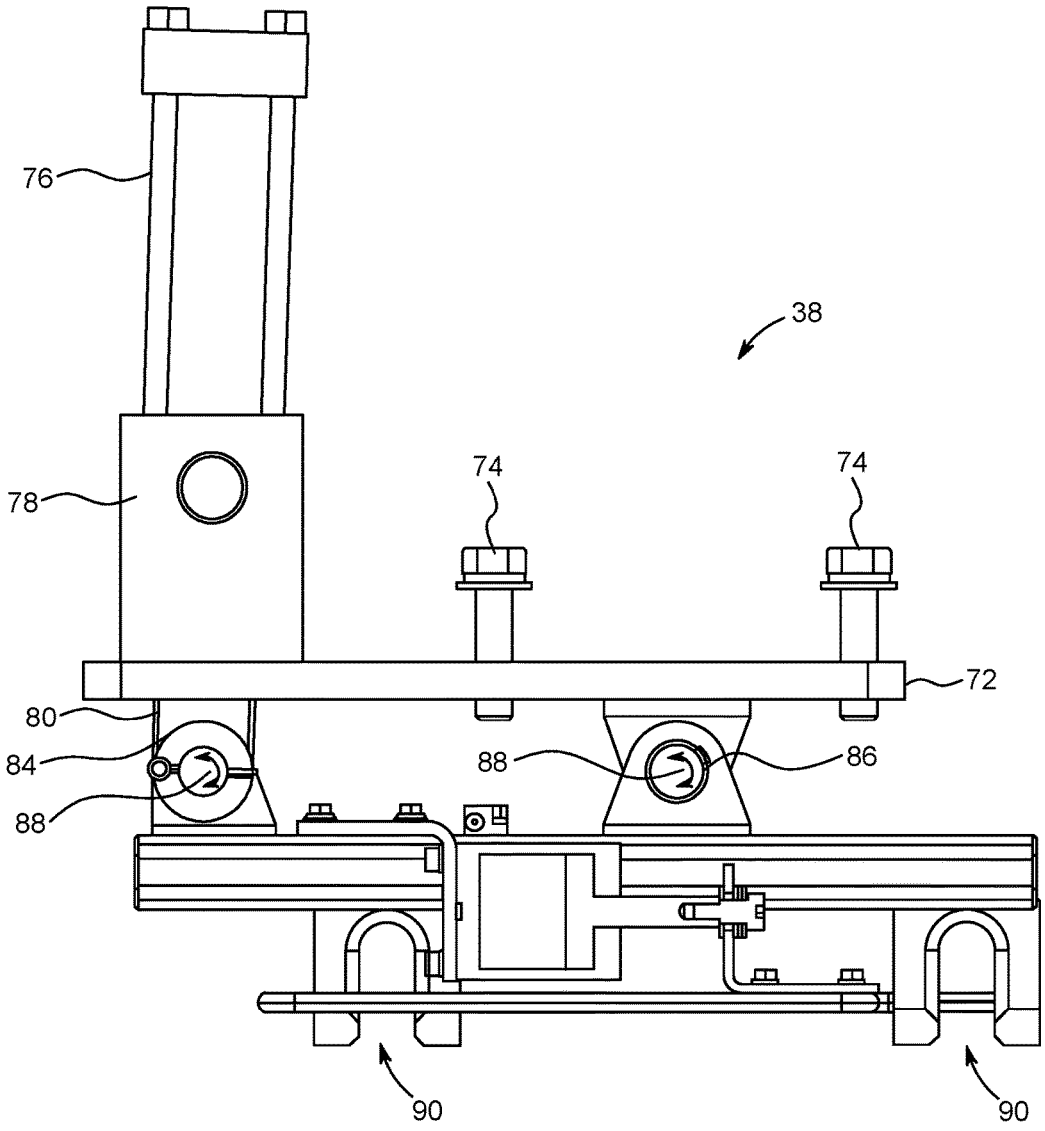
FIG. 8 is a side perspective view of the tilting mechanism of FIG. 1, the view showing the axis of rotation of the tilting mechanism as well as the tilt cylinder that imparts the rotation, the view showing the tilting mechanism in a generally flat or horizontal position.
Figure 9:
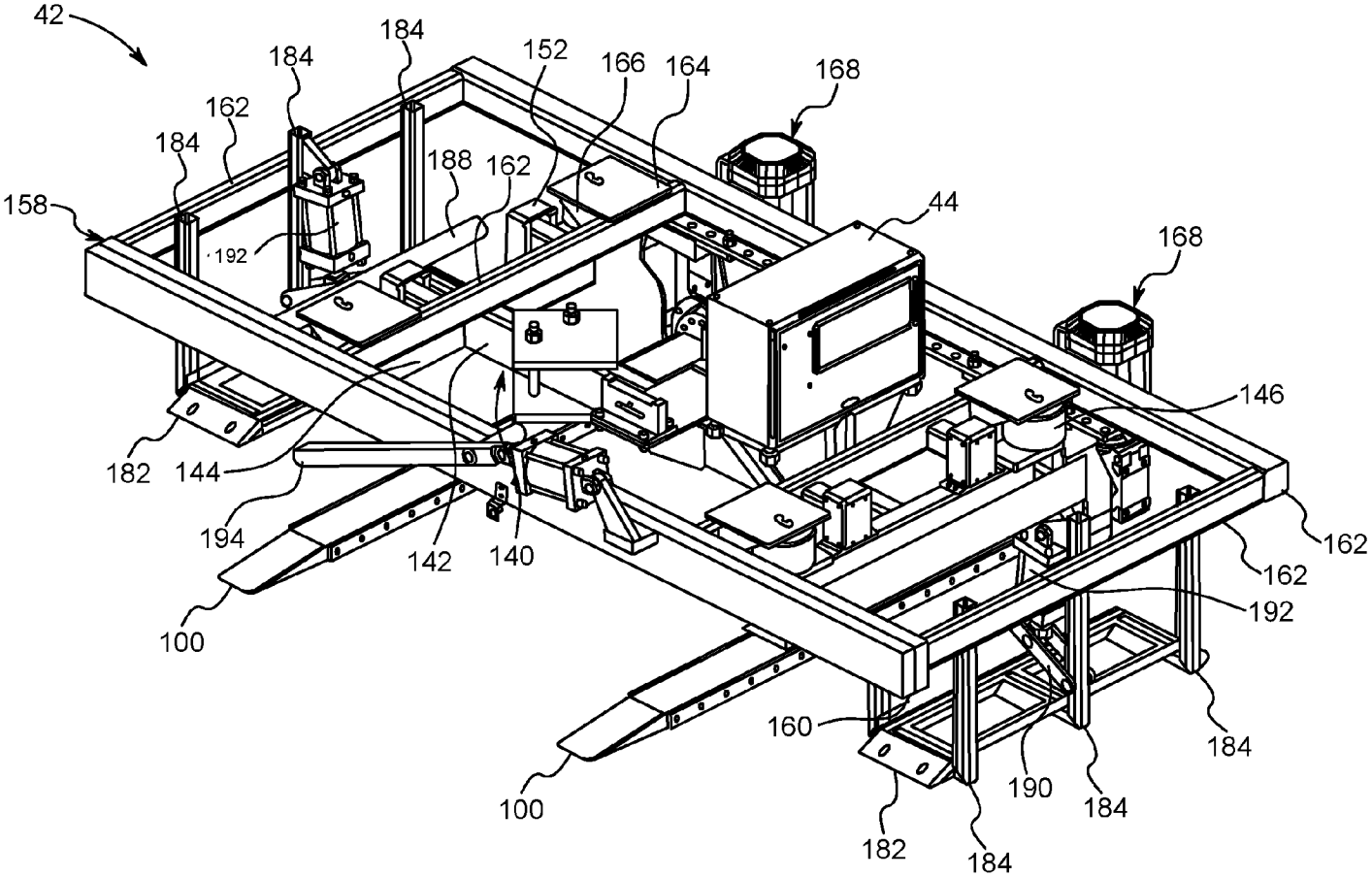
FIG. 9 is a perspective view of the vibrator tool of FIG. 1, the view showing the frame member, including the external frame as well as the internal frame, the fork members, the secondary platforms, the press bars, the safety bar among other features, the view showing the safety bar in an open position thereby allowing a piece of sheet stock to enter the hollow interior of the vibrator tool.
Figure 10:
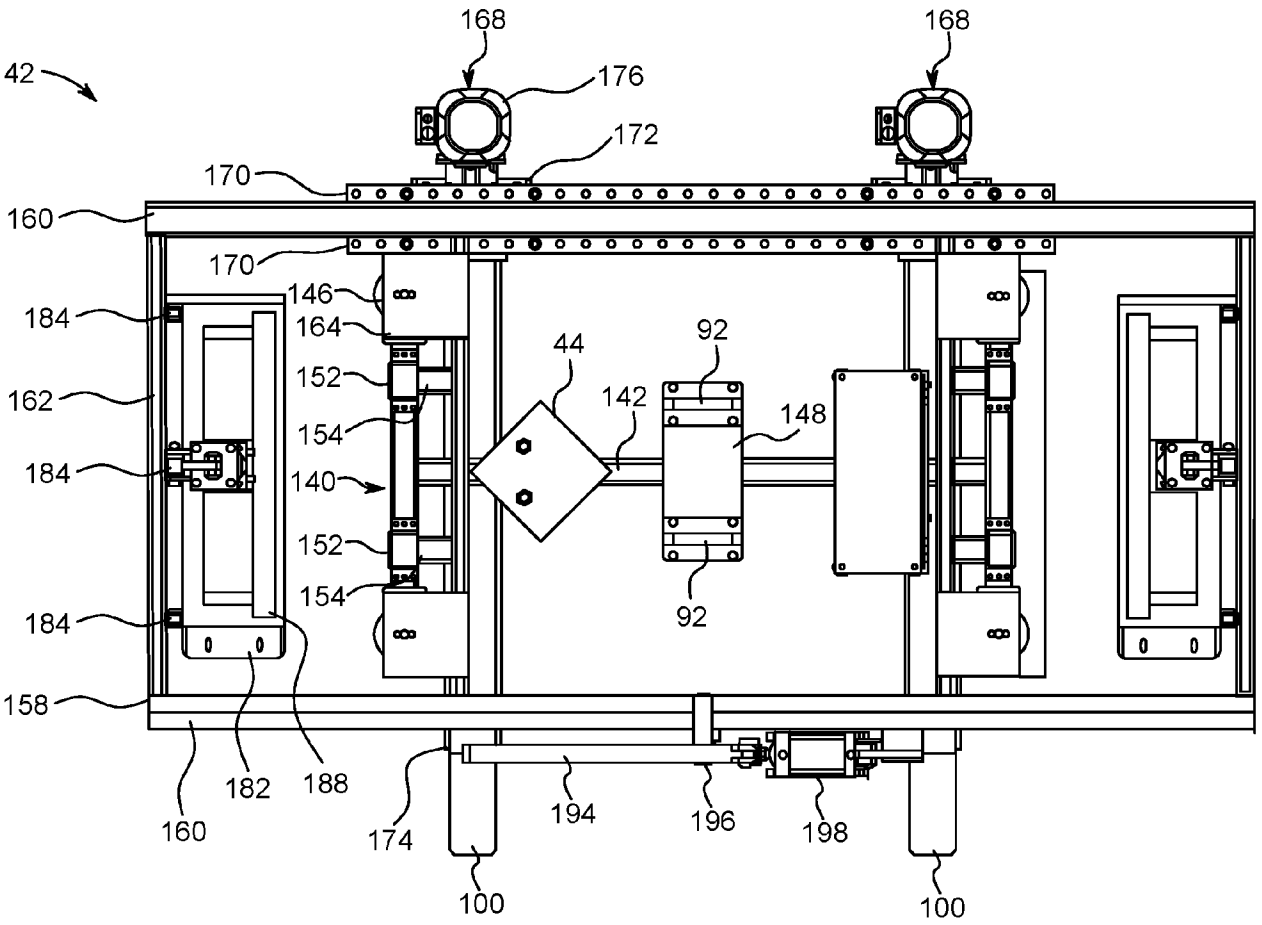
FIG. 10 is a top elevation view of the vibrator tool of FIG. 9.
Figure 11:
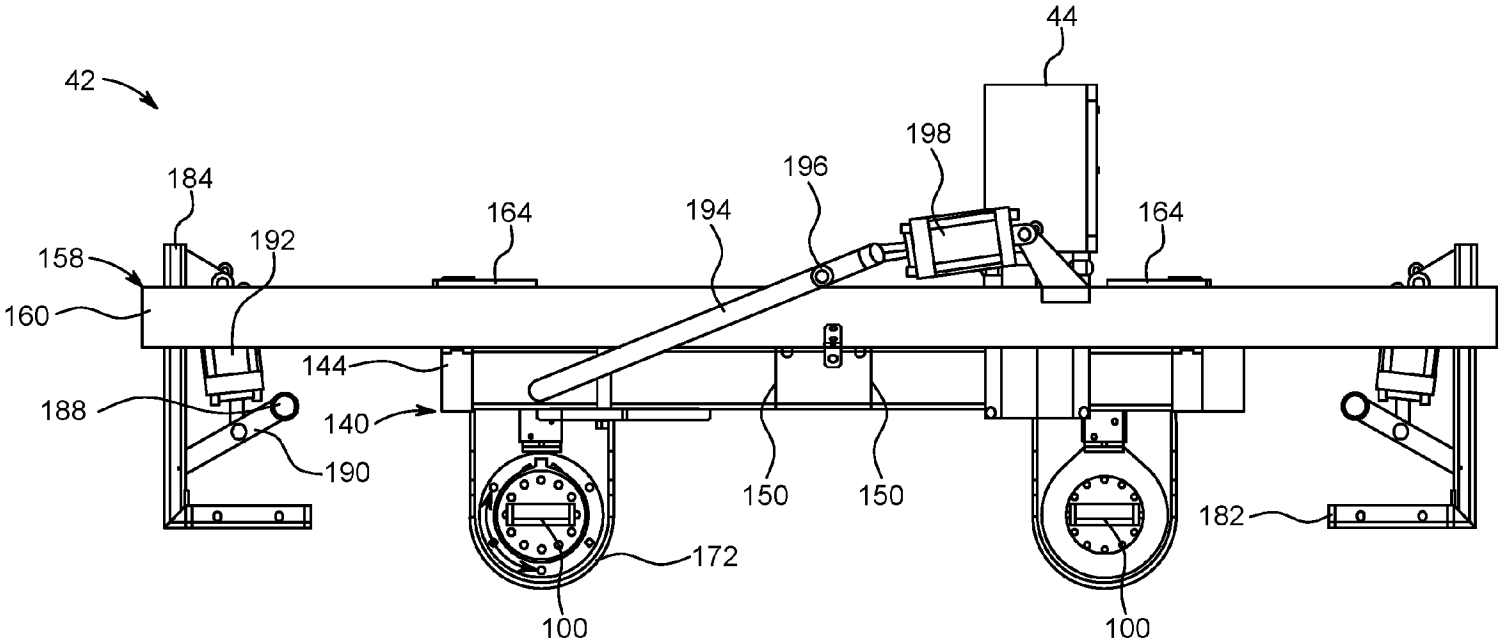
FIG. 11 is a front elevation view of the vibrator tool of FIGS. 9 and 10, the view showing the hollow interior between the bottom side of the frame members and the upper side of the forks and secondary platforms.
Figure 12:
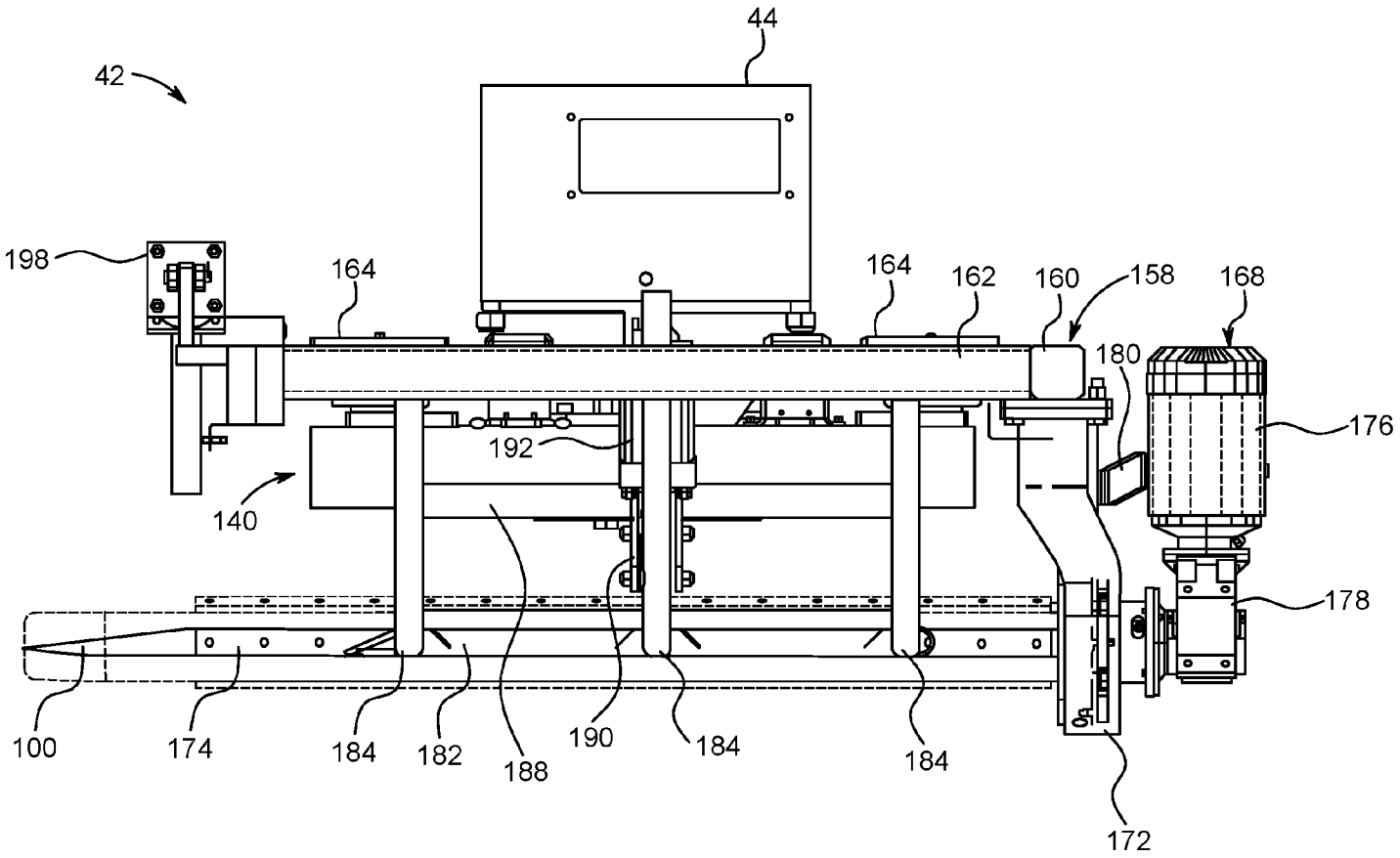
FIG. 12 is a side elevation view of the vibrator tool of FIGS. 9, 10 and 11, the view showing the motion of rotating forks, with the view showing the full range of motion of the forks in dashed lines.
Figure 13:
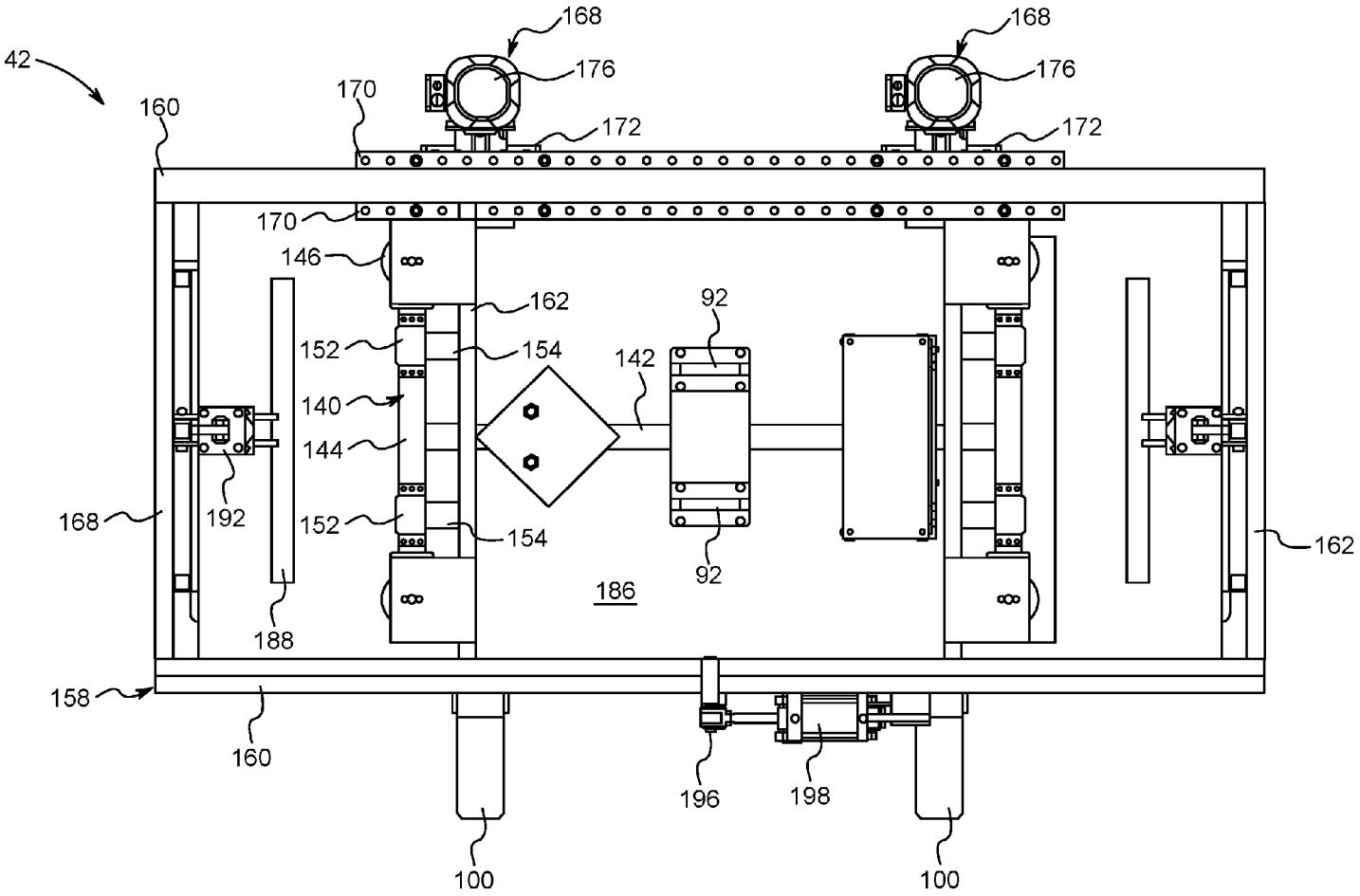
FIG. 13 is top elevation view of the vibrator tool of FIGS. 9, 10, 11 and 12, the view showing a piece of sheet stock positioned within the hollow interior of the vibrator tool and the view showing the safety bar in a down or locked position, the view also showing the press bars in a down or engage position with the sheet stock thereby pressing the sheet stock between the press bars and the secondary platforms.
Figure 14:
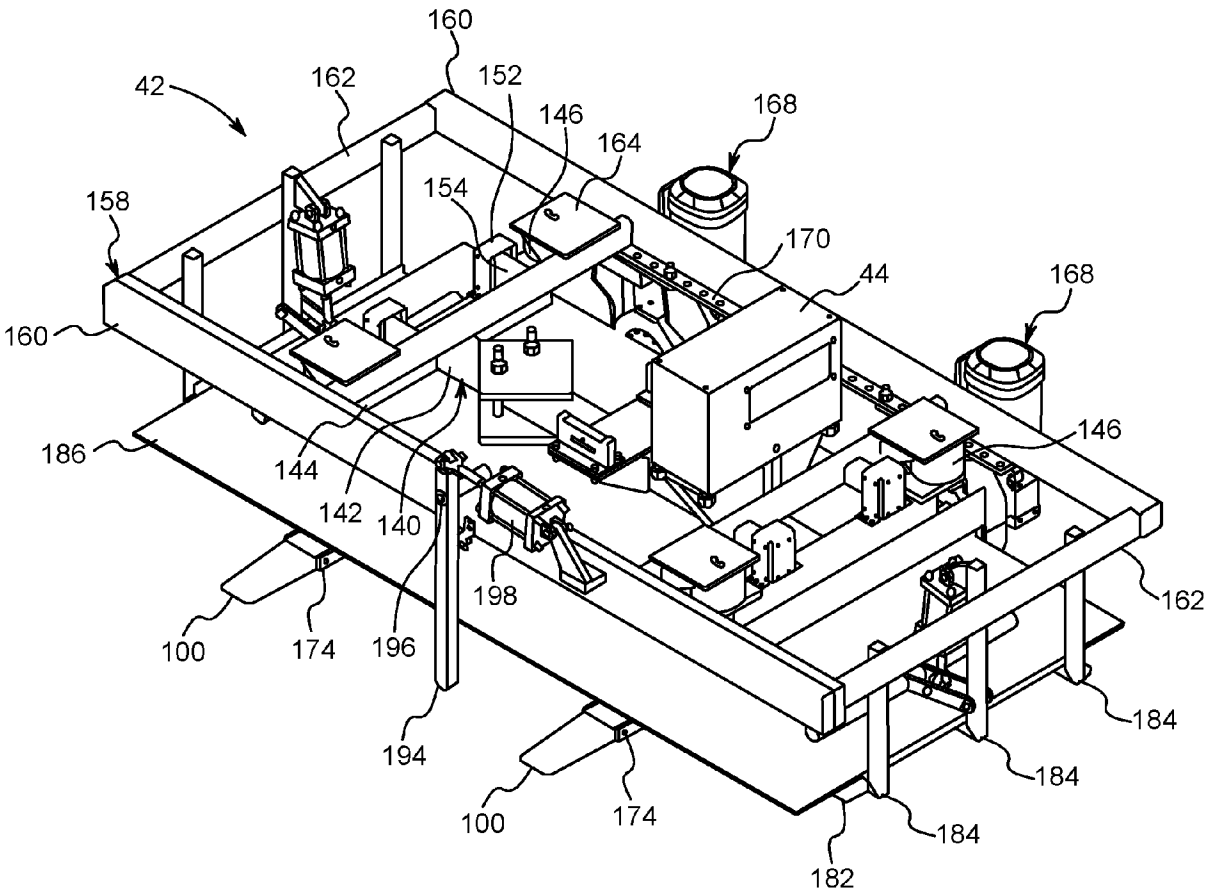
FIG. 14 is a perspective view of the vibrator tool of FIG. 13.
Figure 15:
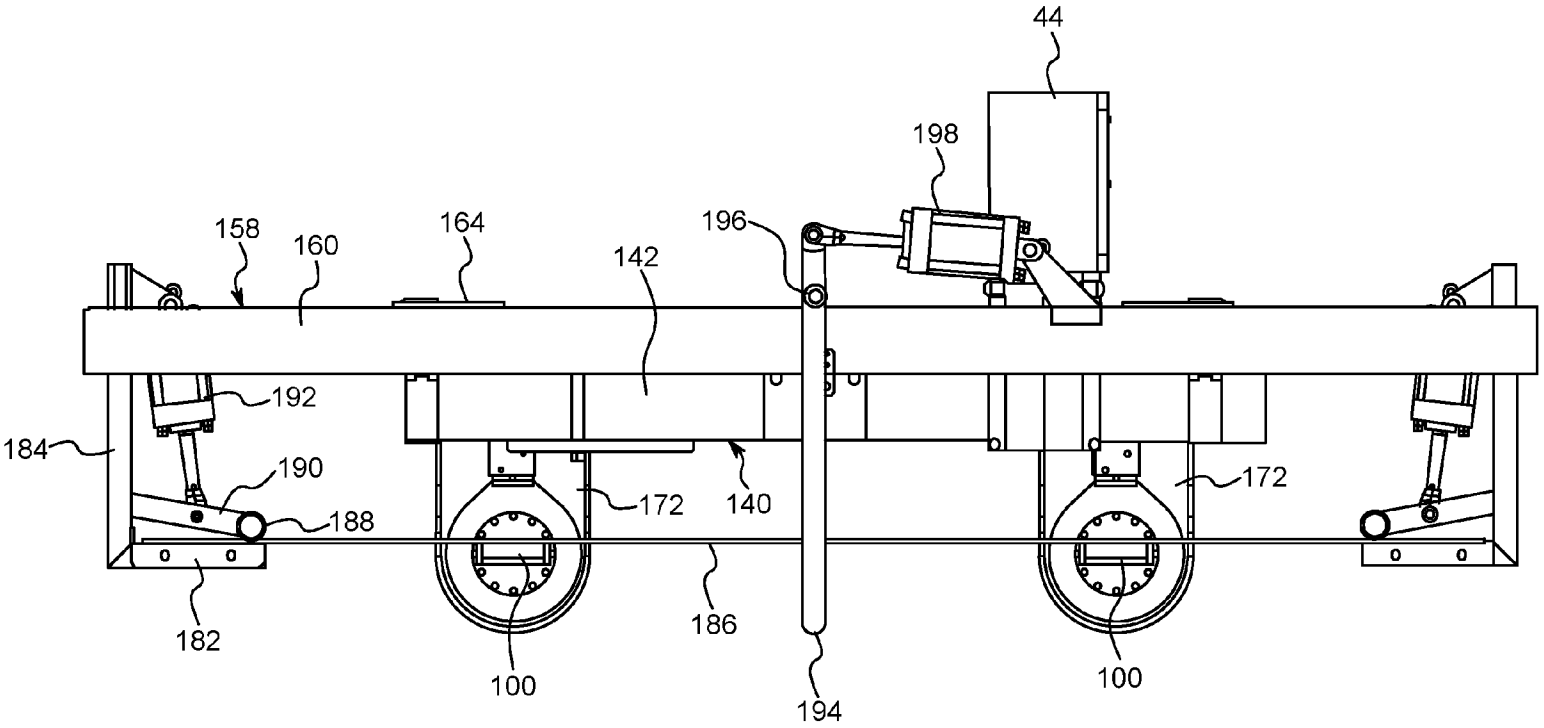
FIG. 15 is a front elevation view of the vibrator tool of FIGS. 13 and 14.
Figure 16:
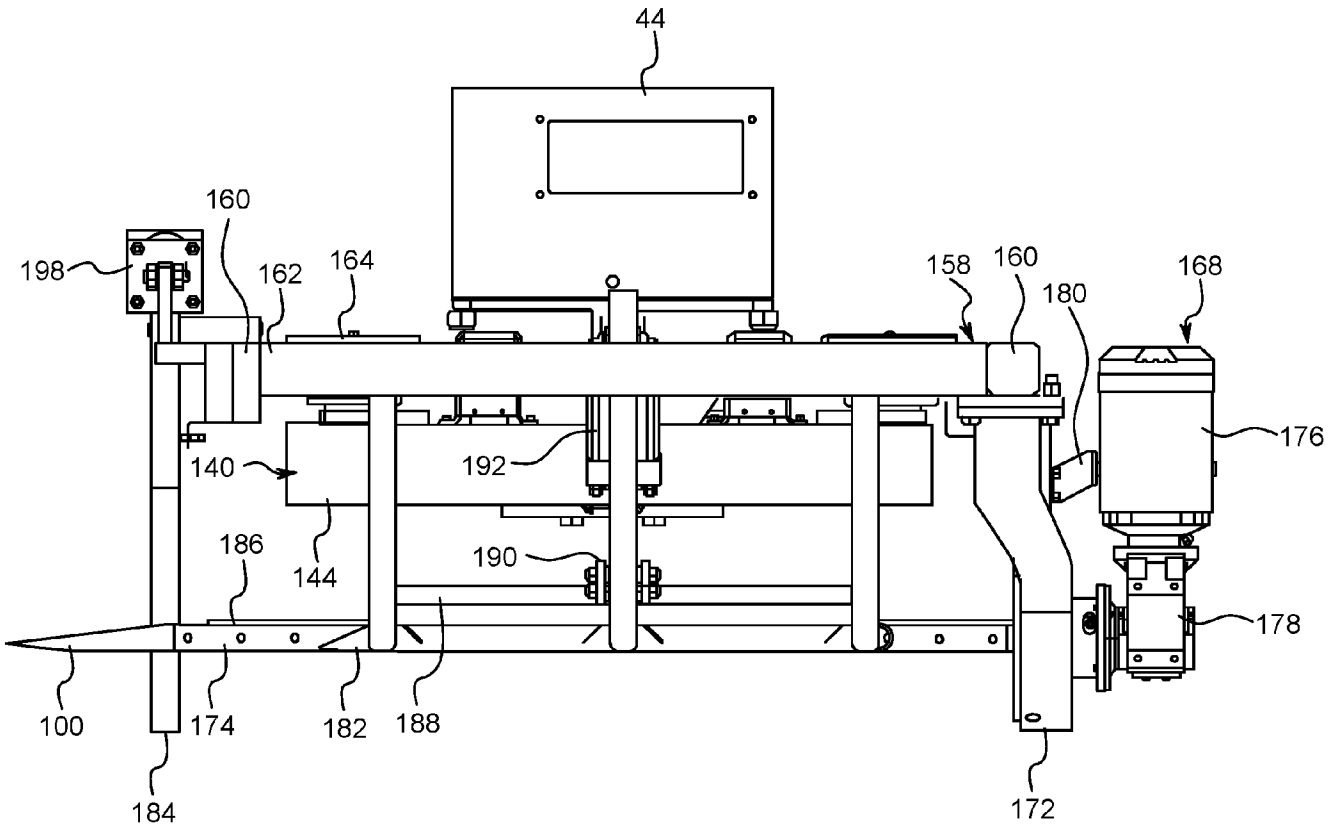
FIG. 16 is a side elevation view of the vibrator tool of FIGS. 13, 14 and 15.
Figure 17:
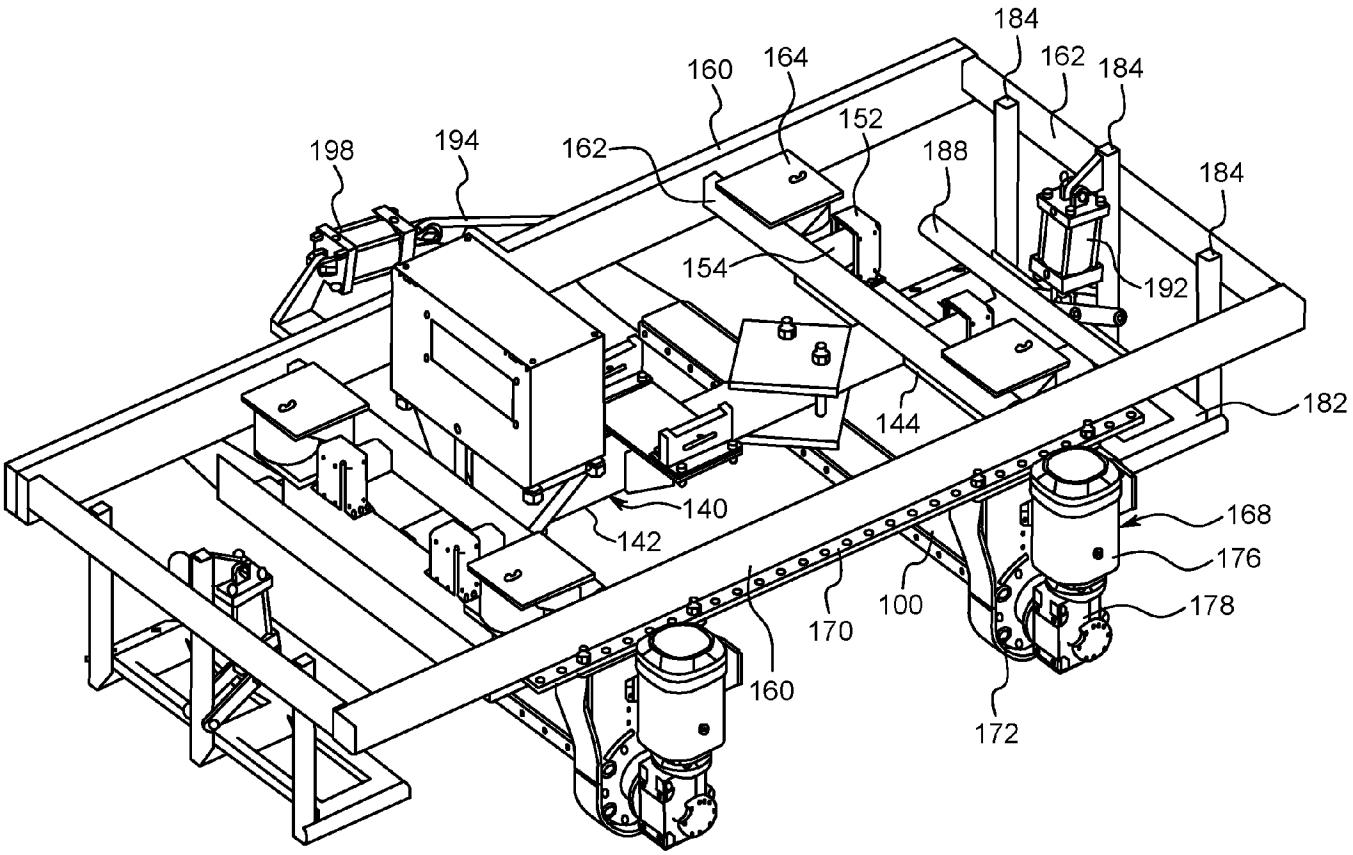
FIG. 17 is a rear perspective view of the vibrator tool with the sheet stock removed.
Figure 18:
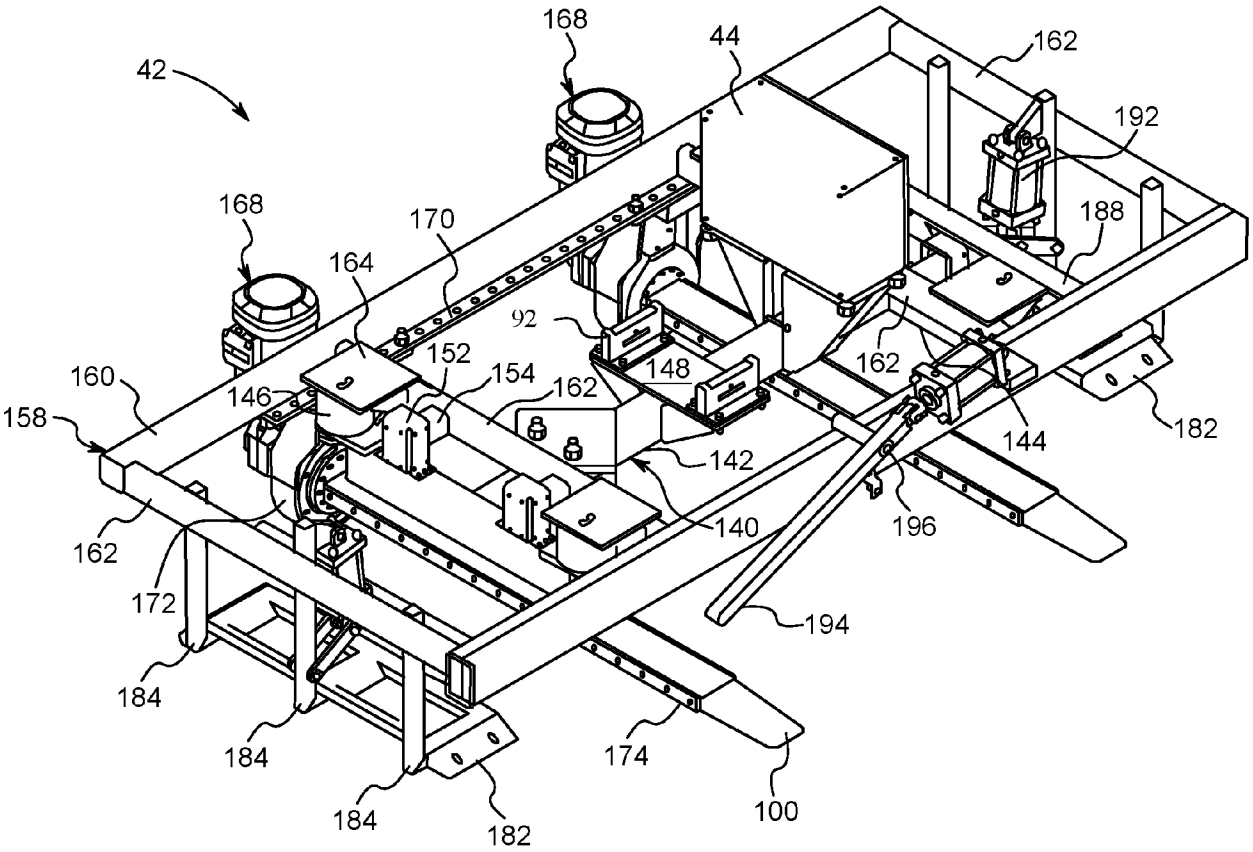
FIG. 18 is a front perspective view of the vibrator tool with the sheet stock removed.
Figure 19:
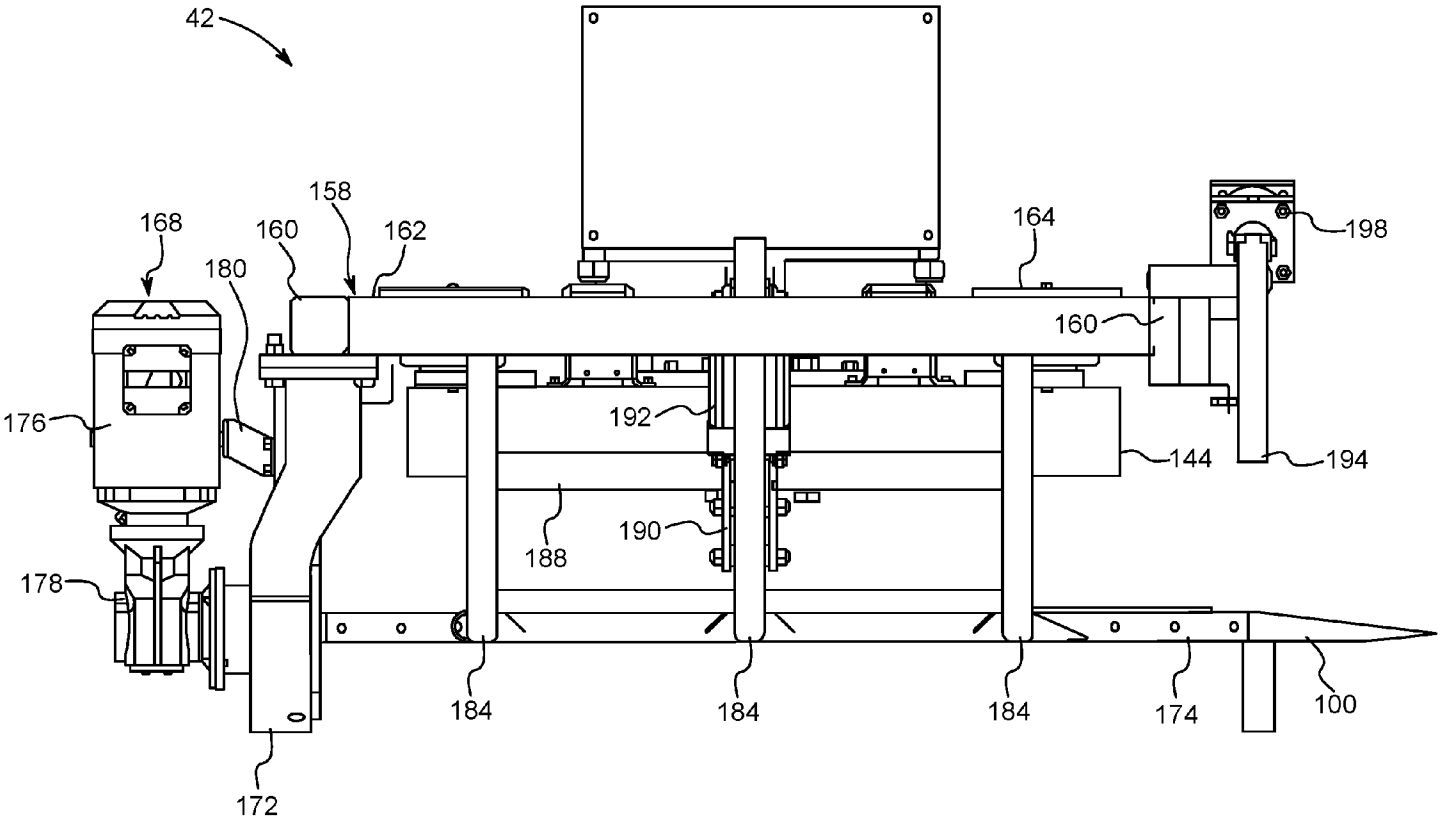
FIG. 19 is a side elevation view of the vibrator tool with the sheet stock removed.
Figure 20:
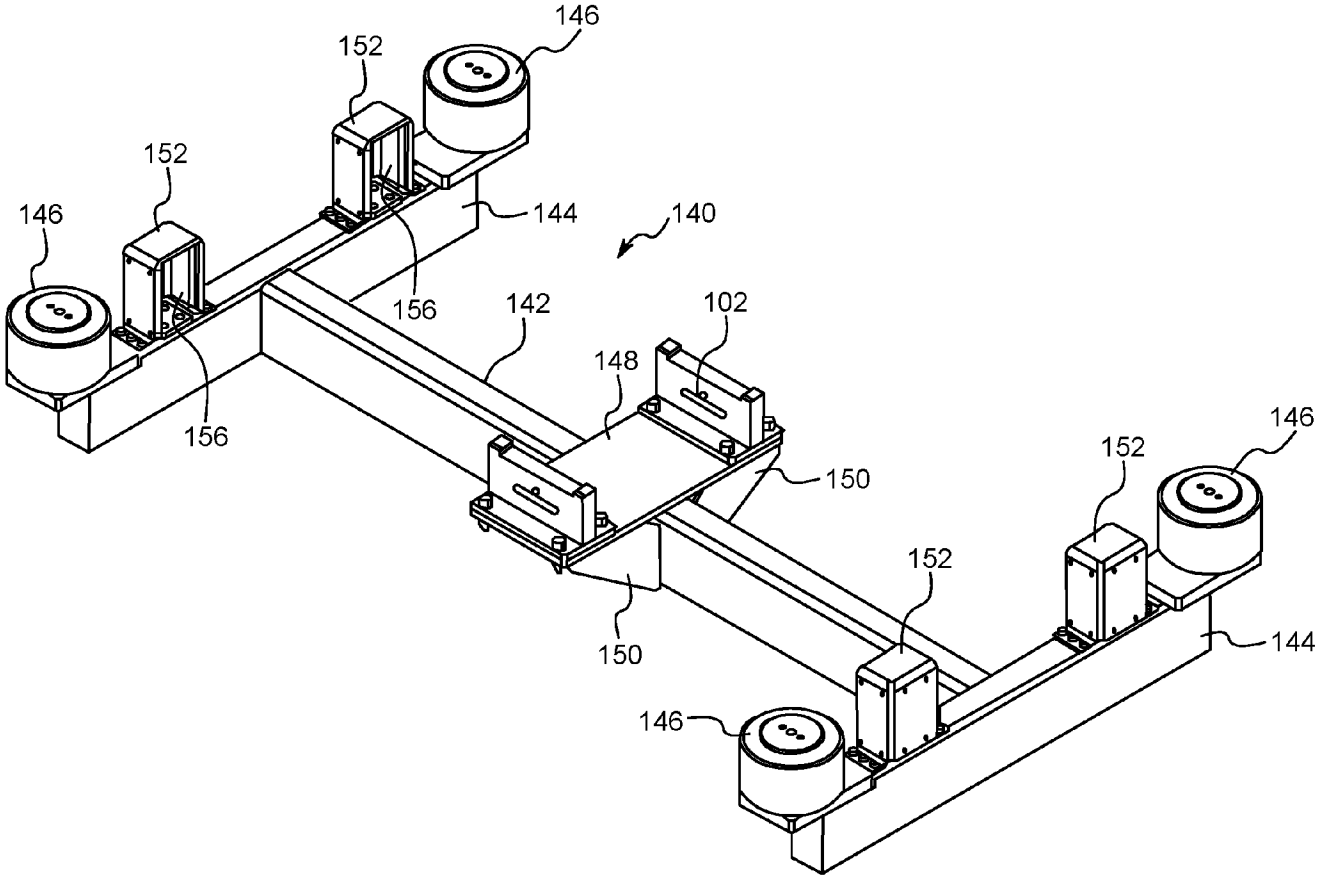
FIG. 20 is a perspective view of the internal frame member, the view showing the center bar, cross bars, shock absorbers and mounting plate.
Figure 21:
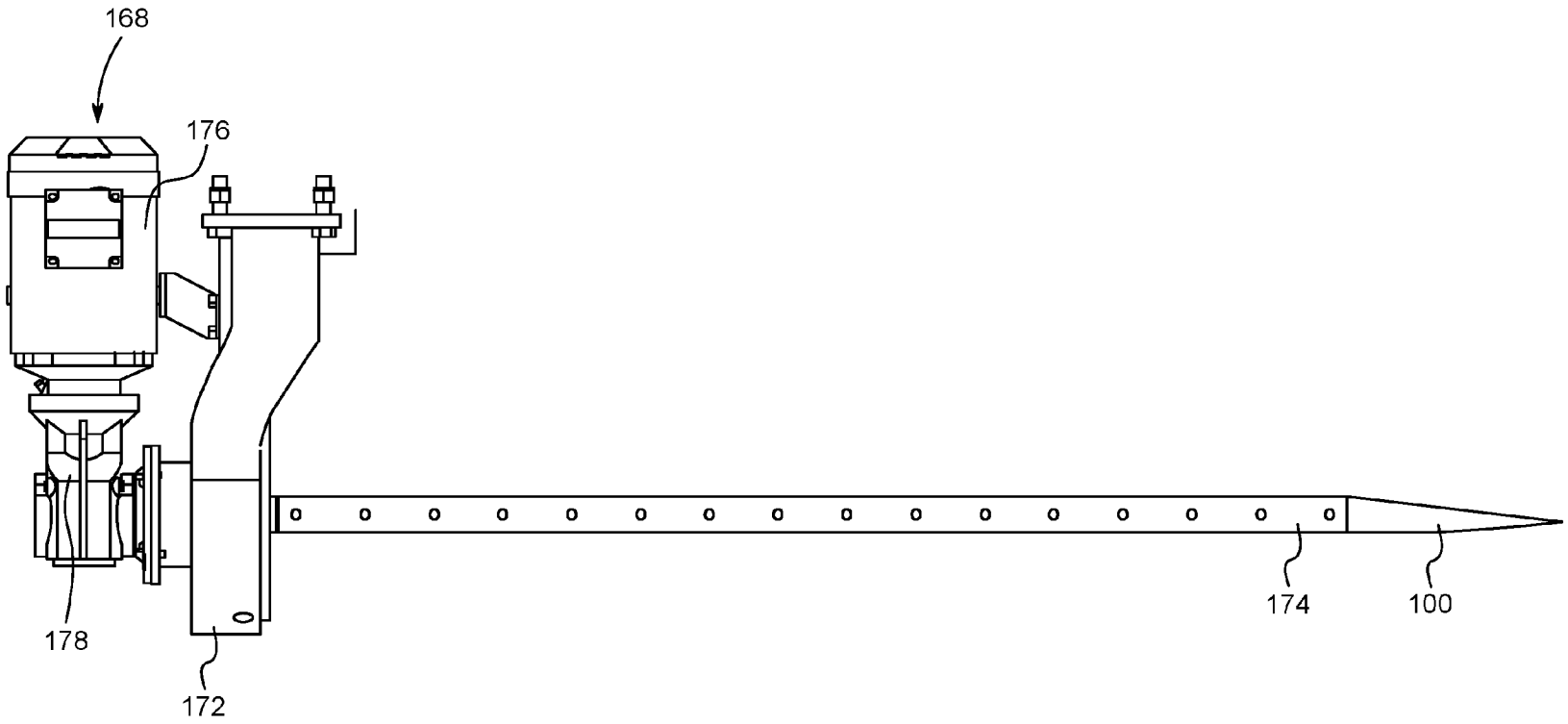
FIG. 21 is a side elevation view of a fork member.
Figure 22:
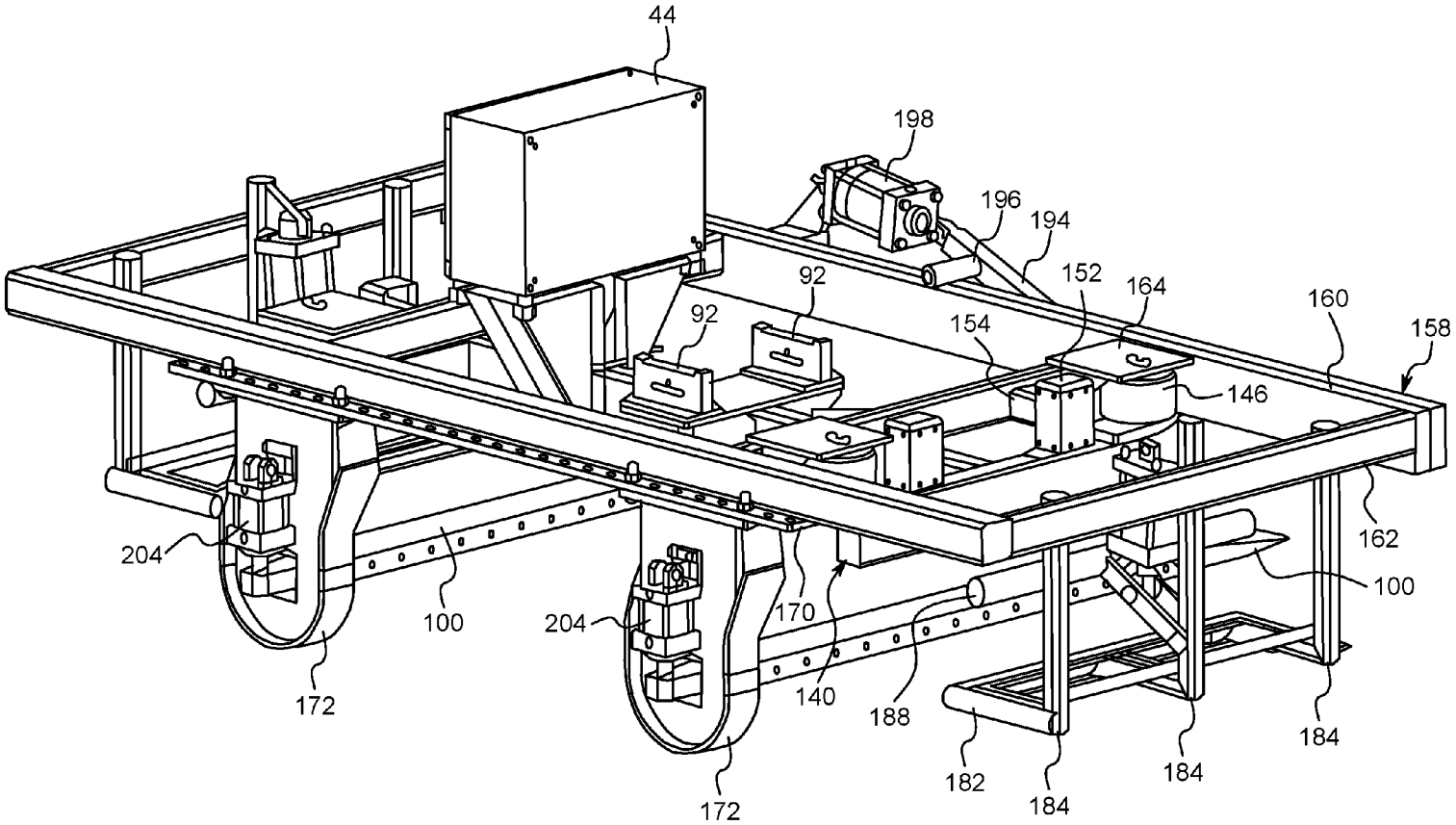
FIG. 22 is a rear perspective view of an alternative arrangement of a vibrator tool with an oscillating member that moves forks in a vertical manner.
Figure 23:
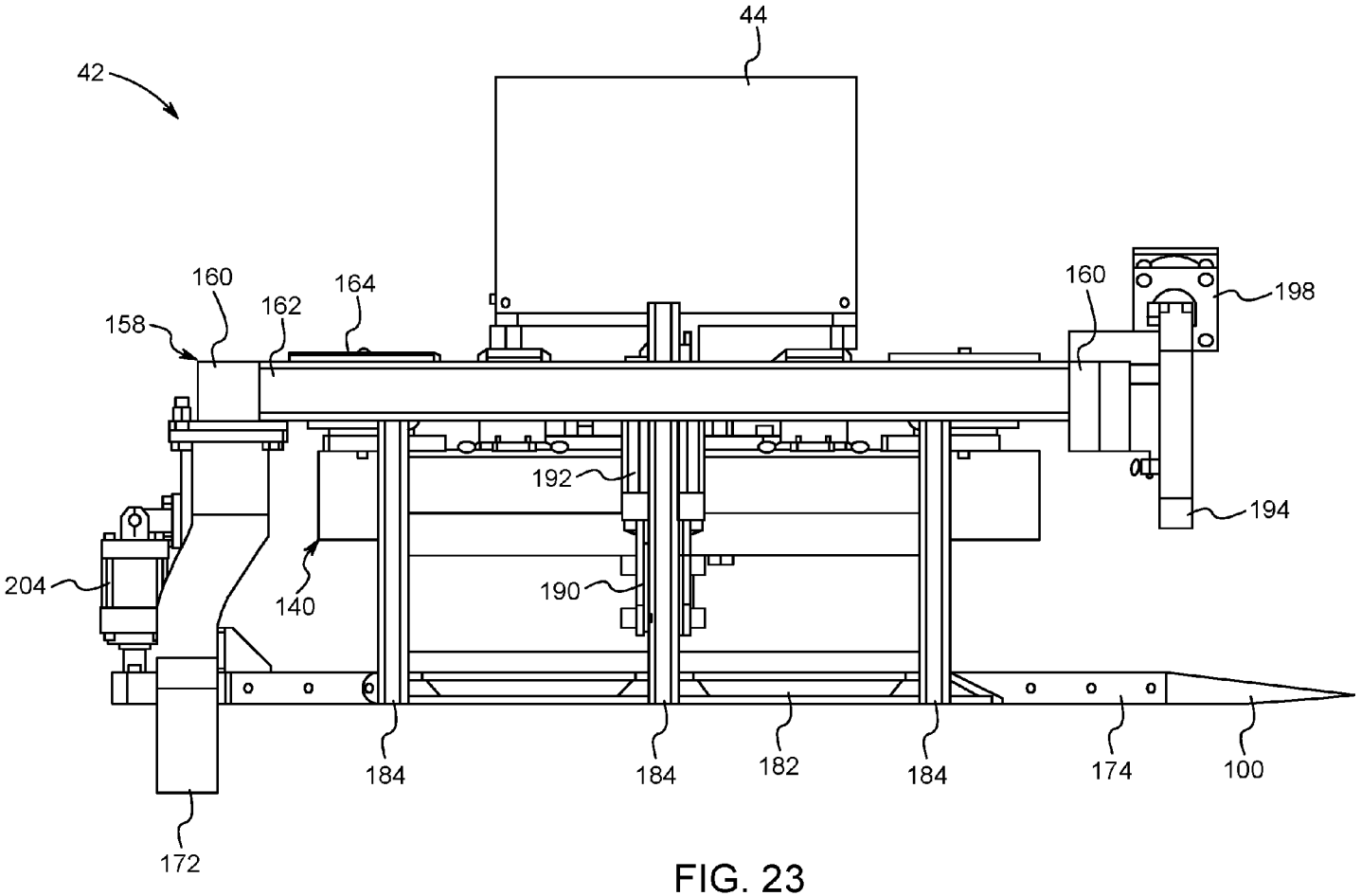
FIG. 23 is a side elevation view of the alternative arrangement of the vibrator tool of FIG. 22.

A material handling system is presented having a frame member and a pair of fork members that form a holding area configured to receive sheet stock therein. The sheet stock includes a plurality of parts that are connected by small tabs of material. The material handling system is used to remove the sheet stock from a cutting tool and dislodge the parts from the sheet stock by impacting the sheet stock with the fork members by rotation or movement of the forks. This arrangement eliminates the need to remove individual parts from a cutting tool, and instead allows for removal of the sheet stock and parts in a single operation thereby improving the utilization rate of the cutting tool and streamlining the manufacturing process.

DETAILED DESCRIPTION OF THE INVENTION

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that mechanical, procedural, and other changes may be made without departing from the spirit and scope of the invention(s). The following detailed description is, therefore, not to be taken in a limiting sense, and the scope of the invention(s) is defined only by the appended claims, along with the full scope of equivalents to which such claims are entitled.

As used herein, the terminology such as vertical, horizontal, top, bottom, front, back, end, sides and the like are referenced according to the views, pieces and figures presented. It should be understood, however, that the terms are used only for purposes of description, and are not intended to be used as limitations. Accordingly, orientation of an object or a combination of objects, especially with respect to one another, may change without departing from the scope of the invention.

Also, reference is made to a laser cutting tool in this specification, however reference to a laser cutting tool is by way of example only and this specification, and any reference to a laser cutting tool, is not to be limiting. Instead, reference to a laser cutting tool should be construed to include any kind of cutting tool (including plasma cutting tools, water jet cutting tools, saws, grinders, stamping, punching or the like). Furthermore, the invention presented herein is not limited to use with cutting tools and is hereby contemplated for use with any mechanical tool or operation and should be construed as such.

With reference to the figures, a manipulator system 10 is presented. Manipulator system 10 is formed of any suitable size, shape or design and serves the purpose of moving sheet stock as well as removing parts from sheet stock after a cutting process, or more specifically a laser cutting process, as is more-fully described herein.

The manipulator system 10 shown includes an overhead system 12, a crane trolley 14, a crane enclosure 16, a post 18 having a spacer section 20 and a middle section 22 and a main post (or lower section 24), a hydraulic power unit 26, a remote control ("RC") receiver 28, an electrical enclosure 30, a rotation bearing 32, a rotation motor 34, a lift cylinder 36, a V-lift section 37, a tilting mechanism 38, and a removable fork tool 40 and vibrator tool 42 having an electrical enclosure 44.

Overhead System:

In the arrangement shown, manipulator system 10 is connected to an overhead system 12. Overhead system 12 is formed of any suitable size, shape and design and serves the purpose of supporting manipulator system 10 while allowing movement of the manipulator system 10 throughout the manufacturing facility. In one arrangement, as is shown, overhead system 12 is a rail system that extends through the manufacturing facility and is spaced the desired distance above the floor. The manipulator system 10 connects to the overhead system 12 and hangs downward therefrom. In this arrangement, manipulator system 10 is moveable along the overhead system 12. However, in an alternative arrangement, the manipulator system 10 is mounted in a stationary manner. That is, while the manipulator system 10 can rotate, as is further described herein, its position is fixed. In yet another arrangement, the manipulator system 10 is configured to be moveable or mounted to a movable device in any other manner or method.

Crane Trolley:

In the arrangement shown, crane trolley 14 is connected to the upper end of manipulator system 10. Crane trolley 14 is formed of any suitable size, shape and design and serves the purpose of connecting manipulator system 10 to rail system 12 while allowing movement of the manipulator system 10 throughout the manufacturing facility along rail system 12. In one arrangement, as is shown, crane trolley 14 includes an upper plate 46 that is generally square or rectangular in shape when viewed from above, and is generally planar in shape. Upper plate 46 includes a number of mounting holes 48 therein that are used to mount other components of the system 10 thereto. In one arrangement, mounting holes 48 receive conventional screws or bolts or the like for mounting purposes. A cross brace 50 is connected to the forward and rearward sides of upper plate 46 and extend from side-to-side between opposing support bars 52, thereby providing structural rigidity and strength to upper plate 46 and trolley system 14. In the arrangement shown, crane enclosure 16 is connected to the forward cross brace 50 and extends downward therefrom.

Crane Enclosure:

In the arrangement shown, crane enclosure 16 is connected to crane trolley 14. Crane enclosure 16 is formed of any suitable size, shape and design and serves the purpose of housing electrical, hydraulic, pneumatic and/or mechanical components related to manipulator system 10 and movement and control thereof. In the arrangement shown, crane enclosure 16 is a generally square or rectangular enclosure that is connected to forward cross brace 50 by bracket 54. Crane enclosure 16 hangs downward from cross brace 50.

Post:

In the arrangement shown, post 18 connects at its upper end to crane trolley 14 and extends downward therefrom. Post 18 is formed of any suitable size, shape and design and serves the purpose of supporting components of manipulator system 10 while allowing the raising, lowering, tilting and rotation thereof. In one arrangement, as is shown, post 18 is formed of three sections, however any number of sections are hereby contemplated for use such as a single section, two sections, four sections, or more. In the arrangement shown, post 18 is generally cylindrical in shape and has a hollow interior allowing for the passage of cords, tubes and other components there through.

Spacer:

In the arrangement shown, post 18 includes a spacer section 20 at its upper end. Spacer section 20 is formed of any suitable size, shape and design and is used to provide the needed space between crane trolley 14 and tools 40/42 and therefore extends vertically any desired length in a fixed or adjustable manner. Spacer section 20 is generally cylindrical in shape and includes mounting flanges 56 at its upper end and lower end. Mounting flanges 56 extend outward from the generally cylindrical exterior surface of spacer section 20 and include a plurality of mounting holes 58. Mounting holes 58 are used for mounting the upper end of spacer section 20 to matching mounting holes 48 in upper plate 46 of crane trolley 14, and for mounting the lower end of spacer section 20 to the upper end of middle section 22.

Middle Section:

Middle section 22, like spacer section 20 is generally cylindrical in shape and includes mounting flanges 56 at its upper end and lower end. Mounting flanges 56 extend outward from the generally cylindrical exterior surface of middle section 22 and include a plurality of mounting holes 58. Mounting holes 58 are used for mounting the upper end of middle section 22 to matching mounting holes 48 in flange 56 of spacer section 20, and for mounting the lower end of middle section 22 to the upper end of main post 24.

In the arrangement shown, hydraulic power unit 26 is connected to middle section 22, however hydraulic power unit 26 can be mounted to any other portion of the system 10, or alternatively it can be mounted remote from system 10. Hydraulic power unit 26 is any device which provides hydraulic power, such as pressurized liquid or gas, to system 10, such as one or more electric motors, one or more hydraulic or pneumatic pump systems and the related electronics and components. Hydraulic power unit 26 is connected to middle section 22 by any manner and means. In the arrangement shown, hydraulic power unit 26 is connected to one or more brackets 60 that connect to middle section 22 and provides a platform for support.

Also in the arrangement shown, one or more electrical enclosures 30 and a RC receiver 28 are also connected to middle section 22. Electrical enclosure 30 is formed of any suitable size, shape and design and serves the purpose of housing electrical, hydraulic, pneumatic and/or mechanical components related to manipulator system 10 and movement and control thereof. In the arrangement shown, electrical enclosure 30 is a generally square or rectangular enclosure that is connected to middle section 22 by one or more brackets 62 that connect to middle section 22.

RC receiver 28 is formed of any suitable size, shape and design and serves as a wireless communication device that can both send as well as receive wirelessly transmitted information, and in this way, RC receiver is both a receiver as well as a transmitter (also known as a transceiver). RC receiver 28 communicates using AM, FM, Bluetooth, Wi-Fi, infrared, 3G, 4G, 5G, or the like or any other frequency, channel, language, protocol or the like. In the arrangement shown, RC receiver 28 is connected to or approximate to electrical enclosure 30 and/or middle section 22. In the arrangement shown, RC receiver 28 is positioned exterior to electrical enclosure 30 so as to provide improved wireless transmission and reception.

Main Post:

Main post 24, like spacer section 20 is generally cylindrical in shape and includes a generally cylindrical mounting flange 56 at its upper end that connects with the mounting flange 56 on the lower end of middle section 22 by way of matching mounting holes 58 therein.

Rotational bearing 32 is positioned a distance below mounting flange 56 of main post 24. Rotational bearing 32 is formed of any suitable size shape and design and provides a manner or means of rotating the lower end of main post 24 with respect to the components above rotational bearing 32 which remain stationary or non-rotational in nature. In one arrangement, as is shown, this rotation is accomplished by a main gear 64 being connected to the upper end of main post 24 a distance below mounting flange 56. Main gear 64 is non-rotational in nature, or is fixed with respect to the other components of system 10. Main gear 64 includes a plurality of gear teeth. Rotation motor 34 is connected to the lower, rotational portion, of main post 24. Rotational motor 34 includes a rotation gear 66 and includes a plurality of gear teeth that mesh with the gear teeth of main gear 64. As rotation motor 34 rotates, so rotates rotation gear 66 which causes the lower portion of main post 24 to rotate around the upper portion of main post 24. In this way, rotation bearing 32 and rotation motor 34 facilitates rotation of the lower portion of main post 24 and/or tool 40/42. Any other structure, manner or method of rotation and/or movement his hereby contemplated for use.

In the arrangement shown, unlike spacer section 20 and middle section 22, which are generally cylindrical in shape, the portions of main post 24 below rotation bearing 32 are generally square or rectangular in cross-sectional shape. However any other shape is hereby contemplated for use. Main post 24 is formed to raise and lower tool 40/42. One manner of accomplishing this functionality is, as is shown, to have main post 24 have an exterior tube section 68 and an interior tube section 70 that slidably fits within the exterior tube section 68 in a telescoping and vertically moveable manner. The square, rectangular or non-round nature of exterior tube section 68 and interior tube section 70, and their mating relationship, allow vertical movement but prevents rotational movement. In this way, the square, rectangular or non-round nature of exterior tube section 68 and interior tube section 70, and their mating relationship, help to maintain alignment of exterior tube section 68 and interior tube section 70.

To facilitate this vertical lifting, lift cylinder 36 is connected to exterior tube section 68 and interior tube section 70. Lift cylinder 36 is any device which raises or lowers one of interior tube section 70 or exterior tube section 68 with respect to the other. In one arrangement, as is shown, lift cylinder 36 is a hydraulic (or pneumatic) cylinder that expands in length and contracts in length. Alternatively, a solenoid, gear and chain system or any other manner method of raising or lowering is hereby contemplated for use. In the arrangement shown, the upper end of lift cylinder 36 connects to exterior tube section 68 whereas the lower end of lift cylinder 36 connects to interior tube section 70. As such, when the lift cylinder 36 expands, the interior tube section 70 slides out of exterior tube section 68 thereby lowering tool 40/42; whereas when the lift cylinder 36 retracts, the interior tube section 70 slides into exterior tube section 68 thereby raising tool 40/42. In an alternative arrangement, main post 24 is fixed in length.

In this way, the components of the exterior tube section 68, interior tube section 70 and lift cylinder 36 cooperate to raise and lower the vertical position of tool 40/42 and in this way these components form the V-lift section 37 also known as the "Vertical lift section."

Tilting Mechanism:

Tilting mechanism 38 is connected to the lower end of V-lift section 37. Tilting mechanism 38 is formed of any suitable size, shape or design and serves to connect main post to tool 40/42 as well as to tilt tool 40/42. In one arrangement, as is shown, tilting mechanism 38 includes a mounting plate 72 that is generally planar in shape and includes a plurality of mounting holes therein. Mounting plate 72 is sized and shaped so as to mate with the mounting flange 56 connected to the lower end of main post 24. Once aligned, mounting plate 72 of tilting mechanism 38 is connected to mounting flange 56 of main post 24 by conventional fasteners 74 such as screws, bolts or the like.

A tilt cylinder 76 is connected mounting plate 72. Like lift cylinder 36, tilt cylinder 76 is any device which raises or lowers, expands or contracts, such as a hydraulic (or pneumatic) cylinder, a solenoid, or alternatively a gear and chain system or any other manner or method of raising or lowering, expanding or contracting is hereby contemplated for use. In the arrangement shown, tilt cylinder 76 is mounted to the upper side of mounting plate 72 by collar 78. A piston 80 of tilt cylinder 76 extends through mounting plate 72 and connects to tilt member 38 at first pivot point 84. Tilt member 38 also connects to mounting plate 72 at a second pivot point 86, which is positioned a distance away from the first pivot point 84. First pivot point 84 and second pivot point 86 rotate on an axis of rotation 88 that are positioned in approximate parallel spaced relation to one another. In the arrangement shown, tilt cylinder 76 is positioned a distance away from the center of post 18, whereas second pivot point 86 is generally centrally positioned with the center of post 18. In this way, as piston 80 expands or contracts, tilt member 38 rotates on second pivot point 86 thereby tilting tilt member 38 with respect to mounting plate 72, main post 24 and the other components of system 10.

Tilt member 38 serves both to attach to tool 40/42 as well as to tilt tool 40/42. In the arrangement shown, tilt member 38 includes a pair of sockets 90 that are spaced apart from one another. Sockets 90 are formed of any suitable size, shape and design and are sized and shaped to receive mounting tabs 92 connected to tool 40/42 in mating and locking engagement.

Fork Tool:

Fork tool 40 is formed of any suitable size, shape and design and serves to pick up and move sheet stock, pallets or any other object or device. In the arrangement shown, fork tool 40, has a frame member 94 that has a generally planar upper wall 96 that connects to a downwardly extending rearward wall 98 at its rearward end. A pair of forks 100 fixedly connect to frame member 94, and more specifically to the inward surface of rearward wall 98 and extend forward therefrom in approximate parallel spaced relation to one another. In this way, fork tool 40, when viewed from the side, forms a C-shape or U-shape. A pair of mounting tabs 92 are connected to the upper surface of upper wall 96 and extend upwardly therefrom. Mounting tabs 92 are generally centrally positioned between the forks 100, and each include a mounting slot 102 therein that is used to lock tool 40/42 to tilting mechanism 38.

Vibration Tool:

Vibration tool 42 is similar to fork tool 40 in that vibration tool 42 includes forks 100 that are positioned in space relation to one another. However, unlike fork tool 40 which has fixedly attached forks 100, the forks 100 of vibration tool 42 rotate, oscillate, vibrate, or otherwise move in any manner as is further described herein. This movement of forks 100 is used to impart vibrations and impact on laser cut sheet stock so as to dislodge parts as is further described herein.

Vibration tool 42 is formed of any suitable size, shape and design. In the arrangement shown, as one example, vibration tool 42 includes an internal frame 140. Internal frame 140 is formed of any suitable size, shape and design and is intended to connect to tilting mechanism 38, and the other components of system 10, while isolating vibration from vibration tool 42. In the arrangement shown, internal frame 140 includes a center bar 142 that connects at its opposing ends to cross bars 144. Cross bars 144 extend in approximate parallel spaced relation to one another and in approximate perpendicular alignment to center bar 142. Center bar 142 and cross bars 144 are shown being formed of square or rectangular tubing, however any other structural component is contemplated for use such as flat beams, I-beams, circular tubing, or any other structural members.

A shock absorber 146 is positioned at each outward end of cross bars 144. Shock absorbers 146 are formed of any compressible member that absorbs shock or vibration such as compressible members, air bags, hydraulic or pneumatic cylinders, rubber bumpers, springs or the like. In the arrangement shown, cylindrical airbags are shown that extend upward from the upper surface of cross bars 144.

A generally planar mounting plate 148 is approximately centrally positioned on center bar 142 and like cross bars 144 extends perpendicularly to the length of center bar 142. Mounting tabs 92 having mounting slots 102 therein extend upward from mounting plate 148. Like the mounting tabs 92 of fork tool 40, the mounting tabs 92 of internal frame 140 are used for mounting to tilting mechanism 38. To provide additional strength and rigidity to mounting plate 148, buttresses 150 extend between the underside of mounting plate 148 and the side of center bar 142 at an angle.

A pair of collars 152, like shock absorbers 146, are connected to each cross bar 144 and extend upwardly therefrom. Collars 152, when viewed from the side, are generally rectangular or cubic in shape and have a hollow interior. The inward facing side of collars 152 are open whereas the outward facing side of collars 152 are closed. The hollow interiors of collars 152 are sized and shaped to receive the ends of mounting posts 154. The hollow interiors of collars 152 are sized and shaped to contain the ends of mounting posts 154 therein while allowing for substantial movement due to vibration. This movement is then dampened by shock absorbers 146. For additional shock absorption, compressible pads 156 are connected to the inward surfaces of hollow interior of collars 152. Compressible pads 156 are formed of any compressible device such as rubber pads or grommets, compressible composite pieces, air bags, bumpers, springs, or the like. In this way, the connection of mounting posts 154 within collars 152 allows internal frame 140 to be rigidly attached to system 10 while allowing the other components of vibration tool 42 to be non-rigidly attached to system 10, thereby allowing for absorption of vibration. In one arrangement, compressible pads 156 are formed of a heavy duty nylon pad and is configured to reduce the friction between the inner and outer support frames to allow the dampeners to control the force transmitted through the members.

As is shown, electrical enclosure 44 is connected to center bar 142 and extends upward therefrom. Electrical enclosure 44 is formed of any suitable size, shape and design and houses the needed electrical, mechanical, hydraulic or pneumatic components needed to operate vibrator tool 42.

External frame 158 is connected to internal frame 140. External frame 158 is formed of any suitable size, shape and design. In the arrangement shown, external frame 158 is generally square or rectangular in shape and is formed of a pair of end bars 160 that extend in approximate parallel spaced relation to one another. End bars 160 are connected to one another by a plurality of cross bars 162. Cross bars 162 extend in approximate parallel spaced relation to one another, and in approximate perpendicular alignment to the length of end bars 160. Cross bars 162 connect at their outward ends to the inward surfaces of end bars 160. In the arrangement shown, one cross bar 162 is positioned at the outward ends of end bars 160, and a pair of cross bars 162 extend between end bars 160 a distance inward therefrom.

Mounting posts 152 extend outward from the inwardly positioned cross bars 162 a short distance. As is shown, the ends of these mounting posts 152 are captured within the hollow interiors of collars 152. As such, as can also be seen, in this arrangement, the internal frame 140 fits within the external frame 158. As can also be seen, the cross bars 162 of external frame 158 are also in approximate parallel spaced relation with the cross bars 144 of internal frame 140, and the end bars 160 of external frame extend in approximate parallel spaced relation to the center bar 142 of internal frame 140.

A shock plate 164 is connected to the inwardly positioned cross bars 162 at the approximate location of shock absorbers 146. More specifically, shock plates 164 are generally planar in shape and when viewed from above are generally square or rectangular in shape. Shock plates 164 are connected at their inward end to the upper end of cross bars 162 between mounting posts 148 on their inward side and end bars 162 on their outward side. Shock plates 164 extend outward from cross bars 162 toward the ends of end bars 160. The bottom surface of shock plates 164 connect to or engage shock absorbers 146. In this way, the weight of external frame 158 rests on shock plates 164 which rests upon shock absorbers 146. In this way, the weight of external frame 158 is transferred to internal frame 140 with shock absorbers 146 absorbing or reducing much of the vibration generated from external frame 158. To provide additional strength and rigidity to shock palates 164, a buttress 166 extends between the outward side of cross bars 162 and connects to the bottom side of shock plate 164 on either side of shock absorber 146.

Fork member 168 are connected to external frame 158. Fork members 168 are formed of any suitable size, shape and design. In the arrangement shown, the rearward end bar 160 includes a mounting rail 170 on both the inward side and the outward side of end bar 160. Mounting rail 170 extends a length of the end bar 160 and includes a plurality of mounting holes therein that allow for easy adjustability of position of fork members 168 thereon.

Fork members 168 include a housing 172. Housing 172 connects at its upward end to end bars 160 and/or mounting rails 170. Housing 172 extends downward from end bars 160 a distance.

Forks 100 extend outward from housing 172 toward the other end bar 160. Forks 100 are formed of any suitable size, shape and design. In the arrangement shown, forks 100 are generally elongated and rectangular in shape and include a tapered nose or end. In one arrangement, a replaceable wear plate 174 is connected to the outward sides of forks 100. In the arrangement shown, wear plate 174 is affixed to forks 100 by conventional fasteners, such as screws or bolts or the like.

A motor 176 and gear and bearing mechanism 178 are also connected to housing 172 and extend outward from housing 172 on the opposite side of housing 172 as forks 100. Motor 176 is any motor or other device that causes rotation of forks 100. Gear and bearing mechanism 178 is any device that converts rotation of motor 176 to rotation of forks 100, as well as in some arrangements reducing the rotations per minute of the motor 176 to the desired rotations per minute of the forks 100. Due to the large forces on forks 100, and the moment formed by the length of forks 100, care must be taken to ensure housing 172, motor 176 and gear and bearing mechanism 178 are structurally rigid and durable to endure these forces while ensuring a long useful life. To provide additional rigidity and durability, motors 176 are connected to housing 172 with the use of a secondary bracket 180.

In one arrangement, to save space, motor 176 is aligned in an approximate perpendicular manner to the length of forks 100. That is motors 176 are generally vertically aligned whereas forks 100 are generally horizontally aligned, however any other arrangement is hereby contemplated for use. In this arrangement, gear and bearing mechanism 178 may include a rack and pinion or ring and pinion gear arrangement that converts rotation in one direction (such as around a vertically aligned axis) to rotation in another direction (such as around a horizontally aligned axis).

In this arrangement, as motor 176 rotates this causes forks 100 to rotate along an axis of rotation that extends through the center of the length of forks 100, as is depicted by arrows in the figures.

In the arrangement shown, secondary platforms 182 are positioned at the opposing outward edges of vibrator tool 42. More specifically, secondary platforms 182 are connected to the outwardly positioned cross bars 162 by support bars 184 that extend downwardly from the outwardly positioned cross bars 162. The upper surface of secondary platforms 182 are positioned in approximate planar alignment with the upper surface of forks 100. In this way, when a piece of sheet stock 186 is grabbed by forks 100 and rests upon forks 100, the outward ends of sheet stock 186 rests upon secondary platforms 182 and the support bars 184 prevent the sheet stock 186 from escaping out the side of the vibrator tool 42. In an alternative arrangement, the upper surface of secondary platforms 182 are positioned approximate parallel alignment with the upper surface of forks 100 but is offset vertically, either above or below, the upper surface of forks 100. In one arrangement, secondary platforms 182 are shorter than forks 100 and only extend a distance between end bars 160 of external frame. Like forks 100, the forward edge of secondary platforms 182 are tapered or pointed to ease pick-up of sheet stock 186.

A press bar 188 is connected by a bracket 190 to support bars 184 and includes a press bar cylinder 192. Press bar 188 moves by way of a press bar cylinder 192 between an engaged position, wherein the press bar 188 presses down upon secondary platform 182 thereby trapping the ends of sheet stock 186 between the upper surface of secondary platform 182 and the bottom surface of press bar 188, and a disengaged position, wherein the press bar 188 is in a raised position a distance above secondary platform 182 thereby allowing for movement of the ends of sheet stock 186 between the upper surface of secondary platform 182 and the bottom surface of press bar 188. Press bar cylinder 192 is any device that moves press bar between an engaged position and a disengaged position, such as a hydraulic piston, a pneumatic piston, a solenoid or any other device.

While secondary platforms 182 are shown positioned at each side of vibrator tool 42 to capture the outward edges of sheet stock 186, it is hereby contemplated to place a secondary platform 182 and associated press bar 188 at the rearward side of vibrator tool 42 to capture the rearward side of sheet stock 186. This rearwardly positioned secondary platform and press bar 188 may extend the entire side-to-side length of vibrator tool 42, or alternatively may be narrower and may occupy only a portion of this side-to-side length, such as one example the space between forks 100. Any other placement, orientation and number of secondary platforms 182 and press bars 188 are hereby contemplated for use.

In one arrangement, safety bar 194 is connected to the forward end bar 160 and pivotally moves between a locked position (or downward position), which prevents the escape of sheet stock 186 from vibrator tool 42 by closing the open front end of vibrator tool 42, and an unlocked position (or raised position) that allows sheet stock 186 to be inserted into or removed from vibrator tool 42 by providing an open front end of vibrator tool 42. In the arrangement shown, safety bar 194 is connected to the forward edge of the forward end bar 160 approximately at its middle and between forks 100. Safety bar 194 is connected to end bar 160 at pivot point 196 and also connects to a safety bar cylinder 198. Safety bar cylinder 198 is any device that moves safety bar 194 between an engaged position or locked position and a disengaged position or unlocked position, such as a hydraulic piston, a pneumatic piston, a solenoid or any other device.

The frame member of vibration tool 42 may be considered any portion of or the entirety of the frame of vibration tool 42 including one or both of the internal frame 140 and/or external frame 158 and the component parts thereof. In addition the holding area of vibration tool may be considered any area that receives sheet stock 186 therein. In one arrangement, the holding area is the area between forks 100 and frame member 42 where sheet stock 186 is received.

In Operation:

Vibrator tool 42 is connected to the lower end of manipulator system 10 by inserting mounting tabs 92 into sockets 90 of tilting mechanism 38. Once inserted, mounting tabs 92 are locked into place by inserting a fastener or other member through mounting slots 102 thereby locking vibration tool 42 to tilting mechanism 38.

Once assembled, in a manufacturing facility, manipulator system 10 is used to move sheet stock 186, such as a sheet of steel, from a stack of sheet stock 186 to a laser cutting table or other manufacturing tool.

Manipulator system 10 moves on overhead system 12 to position itself adjacent an edge of sheet stock 186 as it sits upon the stack of sheet stock 186. The vibrator tool 42 rotates into position upon rotation bearing 32 such that the end of forks 100 point toward the edge of the upper-most sheet stock 186. More specifically, rotation motor 34 activates thereby causing rotation gear 66 to drive along the exterior periphery of main gear 64 until the forks 100 point in the desired direction.

The lift cylinder 36 activates either raising or lowering the interior tube section 70 with respect to the exterior tube section 68 in a telescoping manner until the desired vertical position of vibration tool 42, or more specifically forks 100, is reached.

The angle of vibration tool 42, or more specifically forks 100, is adjusted by tilting mechanism 38. That is, the tilt cylinder 76 activates thereby changing its length. As tilt cylinder 76 changes in length this either pulls or pushes tilt member 38 to rotate upon the axis of rotation 88 of second pivot point 86. This causes the angle of tilt member 38 to adjust with respect to mounting plate 72.

Once the desired angle, direction and height of vibrator tool 42, or more specifically forks 100 is achieved, the manipulator system 10 drives forks 100 under the uppermost sheet stock 186 thereby forcing sheet stock 186 into the open interior of vibrator tool 42. Once in position under sheet stock 186, lift cylinder 36 is again activated and the vibration tool 42 is raised thereby raising sheet stock 186 which rests upon forks 100 within the open interior of vibrator tool 42.

Manipulator system 10 drives along overhead system 12 and deposits sheet stock 186 to laser cutting tool in the similar, but opposite manner, in which vibration tool 42 picked up sheet stock 186. That is, vibrator tool 42 rotates into position upon rotation bearing 32 such that the end of forks 100 point toward the laser tool. More specifically, rotation motor 34 activates thereby causing rotation gear 66 to drive along the exterior periphery of main gear 64 until the forks 100 point in the desired direction.

The lift cylinder 36 activates either raising or lowering the interior tube section 70 with respect to the exterior tube section 68 in a telescoping manner until the desired vertical position of vibration tool 42, or more specifically forks 100, is reached.

The angle of vibration tool 42, or more specifically forks 100, is adjusted by tilting mechanism 38. That is, the tilt cylinder 76 activates thereby changing its length. As tilt cylinder 76 changes in length this either pulls or pushes tilt member 38 to rotate upon axis of rotation 88 of second pivot point 86. This causes the angle of tilt member 38 to adjust with respect to mounting plate 72.

Once the desired angle, direction and height of vibrator tool 42, or more specifically forks 100 is achieved, the manipulator system 10 deposits sheet stock 186 onto laser cutting tool and the manipulator system 10 drives away thereby allowing laser cutting tool to perform its cutting operation.

Instead of cutting around the entire periphery of the parts 200 on sheet stock 186 such that the parts 200 fall out of sheet stock 186, in the system 10 presented the laser cutting table cuts all but a small tab 202 of material that continues to connect each part 200 to the sheet stock 186. After all of the parts 200 are cut out of the sheet stock, save for the tabs 202, the manipulator system 10 again picks up the sheet stock 186 from laser cutting tool.

To facilitate effective manufacturing, care is taken to place the tab 202 or tabs 202 in non-critical positions or non-critical surfaces on part 200. That is, after removal of parts 200 from sheet stock 186, a portion of tab 202, or an aberration or other feature or mark is left on part 200. To ensure that this aberration, feature or mark does not cause a problem with use of the part 200, tab 200 is placed in a non-critical surface or a place where it will be removed by a secondary manufacturing operation. The effect of the aberration, feature or mark can further be minimized by closely controlling the cutting process and optimizing the cutting process to leave the smallest possible tab 202 while minimizing the number of parts 200 unintentionally fall out of sheet stock 202.

When manipulator system 10 picks up the sheet stock 186, because each of the parts 200 are still connected to sheet stock 186 by tab 202 or tabs 202 all parts 200 move with the sheet stock 186. Once the sheet stock 186 is picked up manipulator system 10 drives to an unload station.

At the unload station, fork members 168 of vibrator tool 42 begin to rotate forks 100 along an axis of rotation that extends along their length and approximately through their middle. More specifically, motors 176 activate and begin to rotate along their axis of rotation. An output shaft of motors 176 is connected to gear and bearing mechanism 178 which simultaneously rotates and transmits the angle and/or direction of this rotation to rotate forks 100 along the axis of rotation that extends through the approximate center of forks 100 along the length of forks 100. As motors 176 and gear and bearing mechanism 178 rotate, housing 172 holds fork members 168, gear and bearing mechanism 178 and forks 100 in place with respect to the other components of the system. That is, housing 172 rigidly holds the components in place while allowing for the desired rotation of forks 100. Additional structural rigidity is provided by secondary bracket 180 which extends between motor 176 and other components or frame members of vibrator tool 42 and which holds the motor 176 in place with respect to housing 172 and the other components of system 10.

Forks 100 are generally square or rectangular when viewed along their axis of rotation. As such, when forks 100 rotate their exterior edge impacts sheet stock 186 upon each rotation. This impact causes a substantial vibration that is transmitted throughout sheet stock 186. This vibration has a tendency to shake parts 200 which are barely held onto sheet stock 186 by tabs 202. As the forks 100 continue to rotate, these continued impacts and vibrations have a tendency to shake parts 200 loose. That is, as the forks 100 impact sheet stock 186, the weight of parts 200 break tabs 202 and the parts 200 fall off of the sheet stock 186 leaving only an empty part-free skeleton of sheet stock 186.

Modern laser cutting tools are incredibly precise and therefore the width of tab 202 can be closely and tightly controlled. In addition, the position of tabs 202 can be closely and tightly controlled to be in a non-critical position or a position that will be subject to a secondary operation that removes evidence of tab 202. This precision allows for precise control of when and how the parts 200 will break free from tabs 202. In addition, the material properties of sheet stock 186 are a known and properties such as metal fatigue are known and used to ensure that the parts 200 remain connected to sheet stock 186 during transport, but parts 200 release from sheet stock 186 at the unload station. That is, in the arrangement where sheet stock 186 is formed of metal (note that sheet stock 186 may be formed of any material, including nonmetallic materials such as composite, carbon fiber, plastic, fiberglass, UHMW materials or any other non-metallic material) the repeated impacts of the forks 100 on sheet stock 186 harness the properties of metal fatigue, and cause the weakening of the metal over time with repeated impacts or vibrations.

To improve the part 200 removal process, the speed and direction of rotation of forks 100 is controlled and/or varied. That is, each fork 100 can be controlled to rotate either in a clockwise or counterclockwise manner or a combination thereof during any vibration process. In addition, the speed of rotation, the revolutions per minute, of each fork 100 can also be controlled precisely during any vibration operation. Examples of various manners of control include the following:

Each fork 100 may be controlled simultaneously and identically (in speed and direction of rotation) as the other fork 100;

Each fork 100 may be controlled simultaneously and oppositely (in speed and direction of rotation) as the other fork 100;

One fork 100 may be moving while the other fork 100 is stationary;

The forks 100 may be moving at different speeds than one another;

The forks 100 may change directions of rotation at various times;

The forks 100 may be controlled to operate in any other manner.

Varying the speed, operation and/or direction of rotation of forks 100 transmits different vibrations through sheet stock 186 which helps to dislodge parts 200 from sheet stock 186. By varying the operation of forks 100 the process can be optimized to remove parts 200 in the fastest and most efficient manner possible.

In addition, in the arrangement shown, secondary platforms 182 may be used to support the outward sides of sheet stock 186 in a stationary position. In one arrangement, the upper surface of secondary platforms 182 are in approximate parallel planar alignment with the upper surface of forks 100 when forks 100 are level and non-rotating. During a vibration operation, press bar cylinders 192 are activated thereby causing press bars 188 to pinch the ends of sheet stock 186 between press bars 188 and secondary platforms 182. When this occurs, this prevents or reduces the movement of the ends of sheet stock 186 as forks 100 rotate. This causes the vibration to be focused at different portions of sheet stock 186, such as at the middle of sheet stock 186, which can help to dislodge more centrally positioned parts 200. In contrast, when press bars 188 are released, the ends of sheet stock 186 are free to vibrate, which can help to focus the vibrations toward the outer ends of sheet stock 186 thereby helping to dislodge parts 200 positioned toward the outer ends of sheet stock 186. When press bars 188 are released, depending on the thickness and rigidity of sheet stock 186 as the forks 100 rotate this can cause the ends of sheet stock 186 to bang against the secondary platforms 182 further causing release of parts 200. In one arrangement the press bars 188 are controlled in unison, meaning both press bars 188 are in a disengaged position or engaged position simultaneously; whereas in other arrangements the press bars 188 are controlled independently of one another. By varying control of press bars 188 this can help to focus the vibration on various parts of the sheet stock 186. That is, by pinching one end of sheet stock 186 with one press bar 188 and leaving the other end of sheet stock 186 free, this can help to focus vibrations and dislodge parts 200 toward the loose end of sheet stock 186. Further possibilities exist if additional press bars 188 and secondary platforms 182 are presented, such as at the rear side of sheet stock 186, which can also be independently controlled during a vibration operation.

Using the variables of direction of rotation, speed of rotation, turning on and off various forks 100, thickness and position and number of tabs 202 per part 200, and when to engage press bars 188, among other variables, various vibration operations are developed, honed and perfected for each part 200 and each type of sheet stock 186.

As one example of a vibration operation, sheet stock 186 is cut leaving only a thin tab 202 on each opposing end of part 200 connecting parts 200 to sheet stock 186. In the arrangement shown, tabs 202 are slightly off-center to the center of mass of parts 200 so as to encourage rotation and movement of parts 200 during a vibration operation. Initially, forks 100 are positioned approximately equidistant to one another at the middle of sheet stock 186 and approximately equidistant to secondary platforms 182. Forks 100 begin to rotate in opposite directions to one another. That is, one fork 100 rotates in a clockwise manner while the other fork rotates in a counter clockwise manner. This opposite but equal rotation helps to ensure that sheet stock 186 remains generally centrally positioned within vibration tool 42. The rotation begins slowly and speeds up to a maximum predetermined speed. As the forks 100 rotate the outward sides of forks 100 impact sheet stock 186 which begins the process of causing parts 200 to rotate on or shake free of sheet stock 186. At a predetermined time, press bars 188 are pressed down upon sheet stock 186 causing the outer edges of sheet stock 186 to be pinched between press bars 188 and secondary platforms 182. During this portion of the vibration operation, vibration is focused at the middle section of sheet stock 186 causing the parts 200 located towards the middle of sheet stock 186 to dislodge. At a predetermined point in the vibration operation, one or both of the press bars 188 are released while the forks 100 continue to rotate. This causes the vibration to be focused or affect the outer ends of sheet stock 186. As the forks 100 rotate, this causes the ends of sheet stock 186 to engage or bang against secondary platforms 182 and/or the press bar 188 which further helps to dislodge parts 200 toward the outer edges of sheet stock 186. Throughout the vibration operation, the speed and direction of rotation of forks 100 can be changed or varied as can the engagement and disengagement of press bars 188.

While two fork members 168 are shown, any number of fork members 168 can be used such as one, three, four or more. In addition, the position of fork members 168 can be varied along the rearward positioned end bar 160 along mounting rail 170. In one arrangement, fork members 168 are rigidly affixed to mounting rails 170 and in this arrangement the position of fork members 168 remains constant throughout the vibration operation. In another arrangement, fork members 168 are moveable along end bar 160 and mounting rails 170 during the vibration operation by a motor, hydraulic or pneumatic cylinder, gear system, gear and chain system, or any other device which moves the position of one device with respect to another. As the fork members 168 move along end bar 160 and mounting rails 170 during the vibration operation this causes vibrations or impacts to be focused on different parts of sheet stock 186 ensuring that parts 200 across the entirety of sheet stock 186 are dislodged.

In one arrangement, a sensor is used to determine whether any parts 200 remain connected to sheet stock 186, or alternatively to determine when all parts 200 have dislodged from sheet stock 186. In this arrangement, until all parts 200 dislodge the fork members 168 continue to rotate and continue move back and forth across the bottom side of sheet stock 186. In addition, the speed of rotation may be varied, between faster and slower, as well as the direction of rotation can change, from clockwise to counterclockwise, until sensor detects that all parts 200 have dislodged. Harnessing the principle of metal fatigue, parts 200 are assured to dislodge from sheet stock 186, however the amount of time it will take depends on many variables including the thickness of sheet stock 186, weight of part 200, the thickness of tab(s) 202, the position of tab(s) 202, the amount of vibration, speed of vibration, the direction of vibration, the position of vibration, among other variables.

To ensure safety, both during the vibration operation and/or during movement of manipulator system 10 along overhead system 12, the safety bar 194 is lowered by activation of safety bar cylinder 198 into a blocking position, which in the arrangement shown is approximately vertical.

When in a blocking position, safety bar 194 prevents sheet stock from being unintentionally dislodged from the open interior of vibration tool 42.

While engagement of safety bar 194 helps to ensure sheet stock 186 does not accidently come out of vibration tool 42 during a vibration operation, to further ensure that the sheet stock 186 does not come out of the vibration tool 42 during a vibration operation before or during a vibration operation tilting mechanism 38 tilts forks 100 of vibration tool 42 upward. This upward tilting of forks 100 can be any amount such as a small amount (such as one degree for example) to a large amount (such as thirty degrees for example). This tilting ensures that the force of gravity causes the sheet stock 186 to slide rearward within the vibration tool 42 where it cannot become unintentionally dislodged from vibration tool, as opposed to sliding forward where it is only held in place by safety bar 194. As such, the process of tilting vibration tool 42 during a vibration operation provides an additional level of safety to the sometimes violent vibration operation.

After the vibration operation, and all parts 200 are deposited at the unload station (which may be a bin or other container that catches the falling parts), the manipulator system 10 moves the empty skeleton of sheet stock 186 to a recycle station or bin. At the recycle station or bin the safety bar 194 is opened and the tilting mechanism 38 tilts the forks 100 so that the sheet stock 186 skeleton slides by the force of gravity out of the vibration tool 42 and into the recycle bin or station. Thereafter, the manipulator system 10 is free and the process is repeated.

Wear Plates:

As the forks 100 rotate, the outward edges of forks 100 wear against the bottom side of sheet stock 186 over time. As such, in one arrangement, removable wear plates 174 are affixed, by any manner or means to forks 100, such as by bolting or screwing for example. After a substantial amount of use and wear the wear plates 174 are simply removed and replaced. As such, the use of replacement wear plates 174 extends the life of the system 10 and forks 100.

While reference is made herein to use of the manipulator system 10 with respect to a laser cutting process, reference to laser cutting is only one of countless examples. That is, the manipulator system 10 shown and described herein is contemplated for use with any other manufacturing process as well such as water jet cutting, plasma cutting, punching, pressing, molding, or any other process which forms parts connected to a larger frame, body or sheet stock. As such, reference to laser cutting herein is not meant to be limiting and instead is to be broadly construed and interpreted as reference to any manufacturing process that forms parts connected to a larger frame, body or sheet stock.

Figure 24:
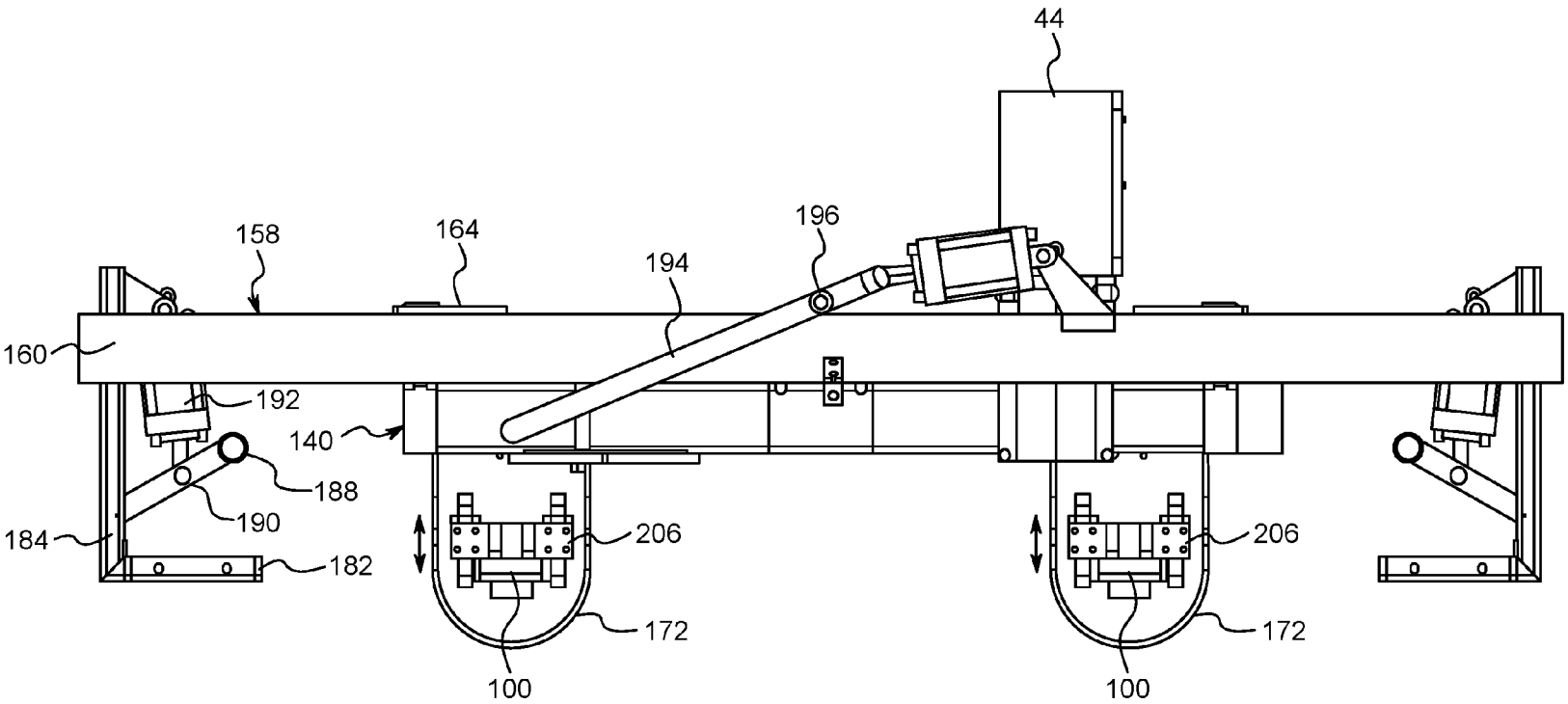
FIG. 24 is a front elevation view of the alternative arrangement of the vibrator tool of FIGS. 22 and 23.
Figure 25:
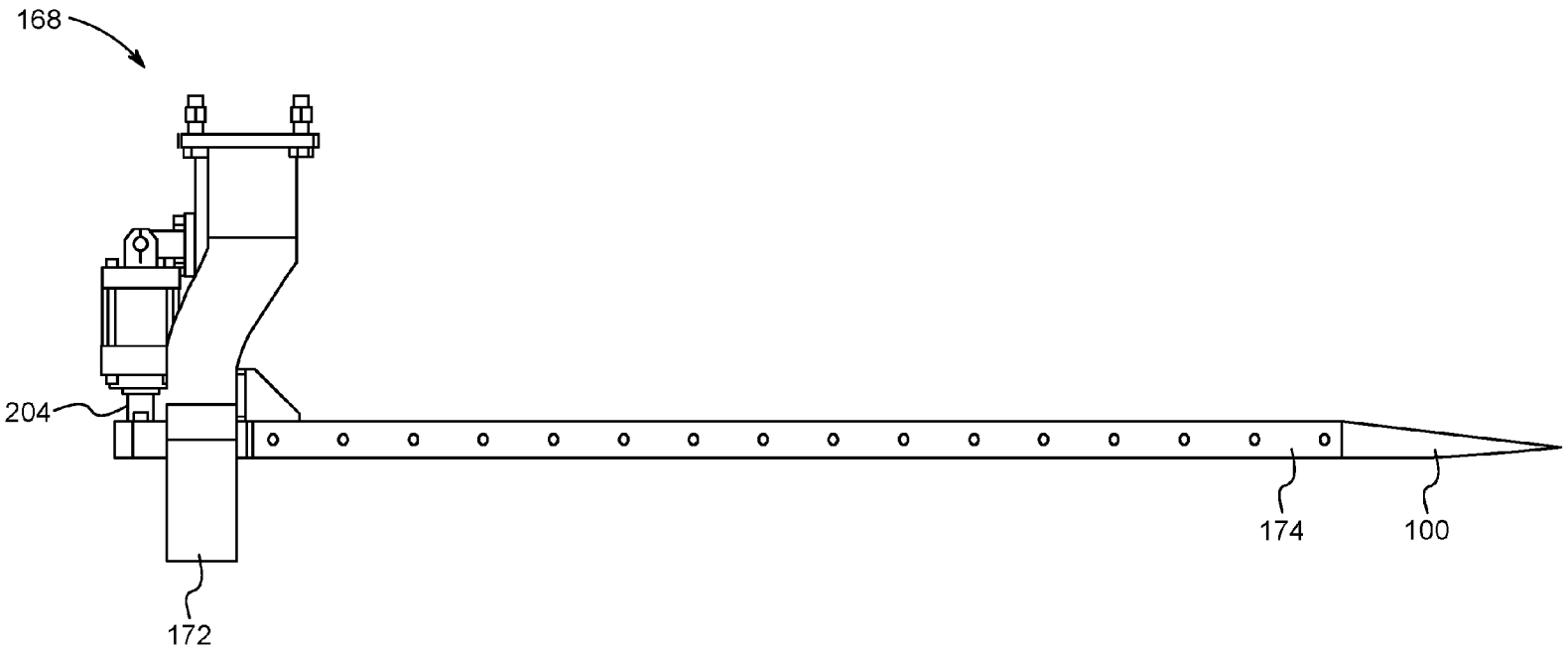
FIG. 25 is a side elevation view of the fork member of FIGS. 22, 23 and 24.
Figure 26:
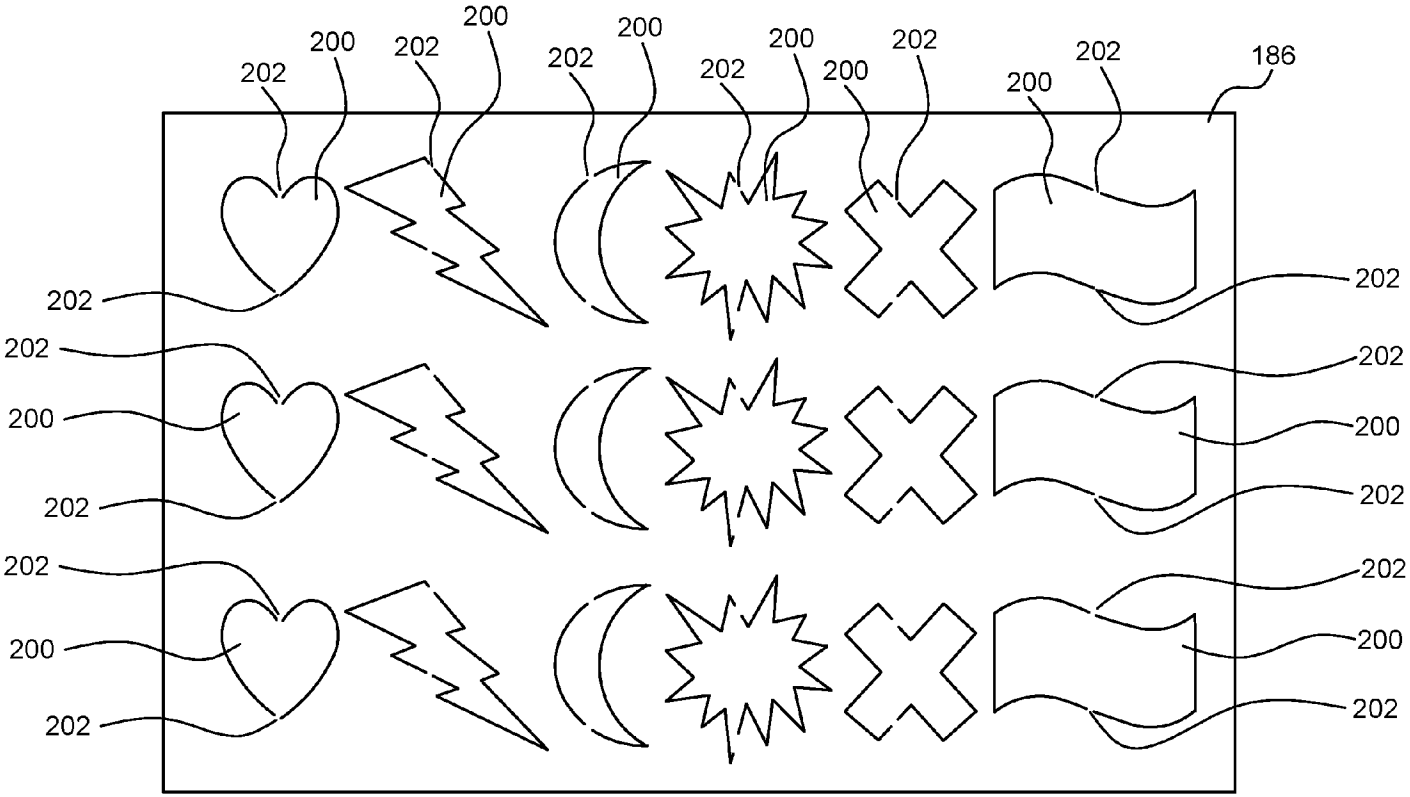
FIG. 26 is a top elevation view of a sheet stock with parts of various shapes cut out of the sheet stock and attached to the sheet stock by tabs.

Impact Members:

While much of the discussion has focused on fork members 168 that impart vibrations by rotation, with reference to FIGS. 22, 23, 24 and 25 fork members 168 are presented that impart vibration by oscillation or vertical impact. That is, in the arrangement shown in FIGS. 22, 23, 24 and 25, forks members 168 include an oscillating member 204 that causes forks 100 to move vertically. This vertical movement causes the forks 100 to impact the sheet stock 186 thereby imparting vibrations and causing parts 200 to be removed from sheet stock 186. In one arrangement, oscillating members 204 include a hydraulic or pneumatic cylinder that raises or lowers fork 100. To provide stabilization to forks 100 during this movement vertical brackets 206 are connected to housing 172 that constrain and hold forks 100 while allowing for vertical movement and oscillation of forks 100 within housing 172. As can be seen in FIG. 24, a fair amount of vertical movement or travel is allowed by vertical brackets 206 as is shown by the associated arrows. In another arrangement, oscillating members 204 include a cam member arrangement that causes rotation to be transmitted into vertical movement. Any other manner, device or method is hereby contemplated for use to cause forks 100 to vertically move.

Hammer Members:

In FIGS. 22, 23, 24 and 25 it is shown that the entirety of fork members 168 oscillate or cause vertical impact. In yet another arrangement, fork members 168 include portions that oscillate or cause vertical impact. In one arrangement, one or more forks 100 include hammer members included within the fork 100 that rise out of the fork 100 thereby impacting sheet stock 186 and causing vibration that shakes parts 200 loose. Hammer members are formed of any suitable size, shape and design and may be pneumatic, hydraulic, electric, mechanical or otherwise and serve as yet another manner of shaking parts 200 loose.

Impact Strips:

In some applications, when forks 100 impact sheet stock 186 marks can be formed in the parts 200, which may be undesirable in some applications. To overcome this problem, in some applications an impact strip may be left in the sheet stock 186 where the forks 100 impact the sheet stock 186. That is, the impact strip is a portion of sheet stock 186 that is free of parts 200. This allows for the use of vibration tool 42 without fear that parts 200 will show any wear no parts 200 are located.

Impact Members:

Regardless of the manner in which the forks 100, or any other object or device impacts the sheet stock 186, either by rotation or vertical movement or by any other manner, the object that impacts the sheet stock 186, such as forks 100 in the examples presented here, are considered to be impact members.

Magnetic Members:

In the arrangement shown and described above, the ends of sheet stock 186 are held into place on secondary platforms 182 by activation of press bars 188 by press bar cylinder 192. When press bar cylinder 192 is activated this forces press bar 188 to mechanically pinch the ends of sheet stock 186 between the press bar 188 and the secondary platform 182. In an alternative arrangement, a magnetic member is used to hold the ends of sheet stock 186 down. That is, in one arrangement secondary platforms 182 are formed of magnetic members or include magnetic members therein that when activated magnetically attract the ends of sheet stock 186 thereto and thereby hold the ends of sheet stock 186 to the secondary platforms 182. In one arrangement, magnetic members are formed of electromagnets that can be quickly turned on and turned off.

From the above discussion it will be appreciated that the manipulator system and method of use presented that improves upon the state of the art.

Specifically, the manipulator system and method of use presented: is easy to use; is safe to use; eliminates the need to have a person pick up individual cut pieces from a laser cutting machine; provides high quality pieces; improves through put; improves safety; reduces manufacturing costs; eliminates the need for additional machinery; deposits cut pieces in a collection area; is fast to use; has a simple design; repeatedly and reproducibly removes parts from sheet stock; rarely if ever leaves parts attached to sheet stock; is usable with sheet stock of varying thickness; has a robust design; has a long, useful life; can be used with a wide array of part designs; eliminates ergonomically undesirable processes;

can be fully automated and/or controlled remotely; is, relatively speaking, inexpensive, among countless other improvements and advantages.

It will be appreciated by those skilled in the art that other various modifications could be made to the device without parting from the spirit and scope of this invention. All such modifications and changes fall within the scope of the claims and are intended to be covered thereby.

The invention claimed is:

1. A material handling system comprising:

a tool having a frame;

the tool having at least one impact member connected to the frame;

wherein the at least one impact member is at least one fork member;

the at least one fork member having a motor operatively connected to the at least one fork member such that when the motor is activated the at least one fork member is rotated;

the tool having a holding area operatively connected to the frame;

wherein the holding area is configured to hold a piece of sheet stock;

the piece of sheet stock having parts therein that are connected to the sheet stock by at least one tab, wherein when the piece of sheet stock is held within the holding area of the tool and the motor is activated, the at least one fork member is rotated and upon rotation the at least one fork member contacts the sheet stock thereby causing parts within the sheet stock to be dislodged.

2. The material handling system of claim 1, wherein the frame is formed of an internal frame connected to an external frame.

3. The material handling system of claim 1, further comprising at least one removable wear plate connected to the at least one fork member.

4. The material handling system of claim 1, further comprising at least one shock absorber operatively connected to the frame and positioned to absorb shock.

5. The material handling system of claim 1, further comprising at least one press bar operatively connected to the frame, wherein at least one press bar is configured to selectively constrain the sheet stock.

6. The material handling system of claim 1, further comprising a safety bar operatively connected to the frame, wherein the safety bar is configured to selectively prevent removal of the sheet stock from the tool.

7. A material handling system comprising:

a tool having a frame;

the tool having a first impact member connected to the frame;

the first impact member having a motor operatively connected to the first impact member such that when the motor is activated the first impact member is rotated;

the tool having a holding area operatively connected to the frame;

wherein the holding area is configured to hold a piece of sheet stock;

the piece of sheet stock having parts therein that are connected to the sheet stock by at least one tab;

wherein when the piece of sheet stock is held within the holding area of the tool and the motor is activated, the first impact member impacts the sheet stock and the parts are dislodged from the sheet stock.

8. The material handling system of claim 7, wherein the frame is formed of an internal frame connected to an external frame.

9. The material handling system of claim 7, further comprising at least one removable wear plate connected to the at least one impact member.

10. The material handling system of claim 7, further comprising at least one shock absorber operatively connected to the frame and positioned to absorb shock.

11. The material handling system of claim 7, further comprising at least one press bar operatively connected to the frame, wherein at least one press bar is configured to selectively constrain the sheet stock.

12. The material handling system of claim 7, further comprising a safety bar operatively connected to the frame, wherein the safety bar is configured to selectively prevent removal of the sheet stock from the tool.

13. The material handling system of claim 7, further comprising at least one magnetic member operatively connected to the frame, wherein the at least one magnetic member is configured to selectively constrain the sheet stock.

14. The material handling system of claim 7, further comprising a second impact member, the second impact member connected to the frame.

15. The material handling system of claim 7, wherein the first impact member is a fork.

* * * * *